US006198450B1

(12) United States Patent
Adachi et al.

(10) Patent No.: US 6,198,450 B1
(45) Date of Patent: Mar. 6, 2001

(54) DIELECTRIC RESONATOR ANTENNA FOR A MOBILE COMMUNICATION

(76) Inventors: Naoki Adachi, 6-29-2-202, Ikuta, Tama-ku, Kawasaki (JP); Takashi Fukagawa, 1-13-28-406 Ichikawa, Ichikawa-shi, Chiba-ken (JP); Suguru Fujita, 2-24-62-4-606, Tamagawa, Oota-ku,Tokyo (JP); Kenichi Maeda, 3-33-17-321, Sugao, Miyamae-ku, Kawasaki (JP); Kazuaki Takahashi, 1598-88, Nogaya-cho, Machida-shi, Tokyo (JP); Makoto Hasegawa, 5-22-14-307, Kami Soshigaya, Setagaya-ku, Tokyo (JP); Morikazu Sagawa, 6-1-1-401, Tsurumaki, Tama-shi,Tokyo (JP); Mitsuo Makimoto, 4-5-404, Wakabadai, Asahi-ku,Yokohama (JP)

( * ) Notice: Subject to any disclaimer, the term of this patent is extended or adjusted under 35 U.S.C. 154(b) by 0 days.

(21) Appl. No.: 09/584,789

(22) Filed: Jun. 1, 2000

Related U.S. Application Data

(62) Division of application No. 08/667,266, filed on Jun. 20, 1996.

(30) Foreign Application Priority Data

Jun. 20, 1995 (JP) ..... 7-152878
Jun. 20, 1995 (JP) ..... 7-152879
Jun. 20, 1995 (JP) ..... 7-152880

(51) Int. Cl.[7] ..... H01Q 1/38

(52) U.S. Cl. ..... 343/753; 343/873

(58) Field of Search ..... 343/873, 753, 343/700 MS, 911 R, 767; H01Q 1/38, 19/06

(56) References Cited

U.S. PATENT DOCUMENTS 3,921,177 11/1975 Munson ..... 343/846
4,689,584 8/1987 Sequeira ..... 343/785
5,940,036 * 8/1999 Oliver et al. ..... 343/700 MS

OTHER PUBLICATIONS

K.W. Leung et al, Theory and Experiment of a Coaxial Probe Fed Hemispherical Dielectric Resonator Antenna, IEEE Transactions on Antennas and Propagation, vol. 41, No. 10, Oct. 1993, pp. 1390–1398.

A. Ittipiboon et al, Aperture Fed Rectangular and Triangular Dielectric Resonators for Use as Magnetic Dipole Antennas, Electronic Letters, Nov. 11, 1993, vol. 29, No. 23, pp. 2001–2002.

G.P. Junder et al., Numerical Analysis of Dielectric Resonator Antennas Excited in Quasi–TE Modes, Electronic Letters, Oct. 14, 1993, vol. 29, No. 21, pp. 18810–1811.

(List continued on next page.)

*Primary Examiner*—Michael C. Wilmer
(74) *Attorney, Agent, or Firm*—Israel Gopstein

(57) ABSTRACT

A hemispherical dielectric resonator is arranged on a metal substrate to make a flat surface of the hemispherical dielectric resonator contact with the metal substrate, and a dielectric wave-guiding channel is connected with a curved side surface of the hemispherical dielectric resonator. Therefore, a dielectric resonance antenna in which the hemispherical dielectric resonator and the dielectric wave-guiding channel are placed on the same metal substrate is obtained. A signal transmitting through the dielectric wave-guiding channel is fed in the hemispherical dielectric resonator, the hemispherical dielectric resonator is resonated, and an electromagnetic wave is radiated. Therefore, the dielectric resonance antenna functions as a wave radiation device.

4 Claims, 18 Drawing Sheets

OTHER PUBLICATIONS

K.W. Leung et al, Input Impedance of Aperture Coupled Hemispherical Dielectric Resonator Antenna, Electronic Letters, Jun. 24, 1993, vol. 29, No. 13, pp. 1165–1167.

J.T.H. St Martin et al, Dielectric Resonator Antenna Using Aperture Coupling, Electronic Letters, Nov. 22, 1990, vol. 26, No. 24, pp. 2015–2016.

R.K. Mongia, Half–Split Dielectric Resonator Placed on Metallic Plane for Antenna Applications, Electronic Letters, Mar. 30, 1989, vol. 25, No. 7, pp. 462–464.

R.A. Kranenburg, Microstrip Transmission Line Excitation of Dielectric Resonator Antennas, Electronic Letters, Sep. 1, 1988, vol. 24, No. 18, pp. 1156–1157.

M.W. Mcallister et al, Rectangular Dielectric Resonator Antenna, Electronic Letters, Mar. 17, 1983, vol. 19, No. 6, pp. 218–219.

A.A. Kish et al, Accurate Prediction of Radiation Patterns of Dielectric Resonator Antennas, Electronic Letters, Dec. 3, 1987, vol. 23, No. 25, pp. 1374–1375.

* cited by examiner

DIELECTRIC RESONATOR ANTENNA FOR A MOBILE COMMUNICATION

This application is a Division of application Ser. No. 08/667,266, filed Jun. 20, 1996.

BACKGROUND OF THE INVENTION

1. Field of the Invention

The present invention relates to a dielectric resonator antenna mainly used in a microwave or millimeter wave region for a mobile communication, a satellite communication or a satellite broadcasting.

2. Description of the Related Art

Because a mobile communication, a satellite communication or a satellite broadcasting has been rapidly made progress, a transmit-receive device for the communication has been recently used in a house or automobile. In particular, because an antenna representing a radio terminal of the transmit-receive device is set up outside the house or a mobile station, it is required to downsize the antenna because of conditions for a set-up position and external appearance of the antenna.

Therefore, a resonance antenna is conventionally used as a downsized antenna. In the resonance antenna, a dielectric material having a relative dielectric constant higher than one is used to shorten a physical length of the resonance antenna and downsize the resonance antenna. For example, a microstrip antenna and a hemispherical dielectric resonator antenna are well-known. Because the hemispherical dielectric resonator antenna can be made by using a metal mold or the like and the number of etching steps required to make the hemispherical dielectric resonator antenna is small, the hemispherical dielectric resonator antenna can be easily mass-produced.

2.1. Previously Proposed Art

The hemispherical dielectric resonator antenna is, for example, disclosed in a literature "Theory and Experiment of a Coaxial Probe Fed Hemispherical Dielectric Resonator Antenna" IEEE Transactions on Antennas and propagation, Vol.41, No.10, pp.1390–1398, October 1993.

FIG. 1A is an oblique view of a conventional hemispherical dielectric resonator antenna disclosed in the above literature, and FIG. 1B is a cross sectional view of a hemispherical dielectric resonator shown in FIG. 1A.

As shown in FIGS. 1A and 1B, a hemispherical dielectric resonator 301 filled with a dielectric material is disposed on a ground plane 302, a coaxial probe 303 is tightly inserted in the hemispherical dielectric resonator 301 from a rear surface of the resonator 301 through a coaxial aperture 304 to fix the hemispherical dielectric resonator 301 on the ground plane 302. The coaxial probe 303 is located at a displacement b from the center of the hemispherical dielectric resonator 301. When a signal transmitting through the coaxial probe 303 is fed in the hemispherical dielectric resonator 301, the resonator 301 is resonated, and a linearly polarized wave having a fixed frequency is radiated from the resonator 301.

2.2. Problems to be Solved by the Invention

However, in the conventional hemispherical dielectric resonator antenna, it is required to feed the signal from a rear surface of the resonator 301 to the resonator 301 through the coaxial aperture 304. Therefore, there is a first drawback that it is difficult to arrange the hemispherical dielectric resonator 301 and the coaxial probe 303 on the same plane and a resonance frequency of the conventional hemispherical dielectric resonator antenna cannot be adjusted.

Also, in the conventional hemispherical dielectric resonator antenna, because the coaxial probe 303 is only inserted in the hemispherical dielectric resonator 301 to fix the hemispherical dielectric resonator 301 on the ground plane 302, there is a second drawback that the connection of the resonator 301 and the ground plane 302 is not sufficient and the resonator 301 easily comes off the grand plane 302. Also, because it is difficult to form an array antenna by setting a plurality of hemispherical dielectric resonator antennas in array, the adjustment of antenna characteristics in the array antenna cannot be performed.

Also, in cases where a positional relationship between a mobile body and a base station changes with the passage of time, an optimum antenna angle changes with the passage of time in the linearly polarized wave, and a wave receiving sensitivity is degraded in the conventional hemispherical dielectric resonator antenna. To perform a mobile communication, there is a case that a circularly polarized wave is utilized in the satellite broadcasting or the satellite communication in place of the linearly polarized wave. However, there is a third drawback that the linearly polarized wave is only used in the conventional hemispherical dielectric resonator antenna and the conventional hemispherical dielectric resonator antenna has no operational function for the circularly polarized wave.

SUMMARY OF THE INVENTION

A first object of the present invention is to provide, with due consideration to the drawbacks of such a conventional hemispherical dielectric resonator antenna, a dielectric resonator antenna in which a signal feeding line and a dielectric resonator are formed on the same plane and a resonance frequency of the antenna is adjustable.

A second object of the present invention is to provide a dielectric resonator antenna in which a hemispherical dielectric resonator is reliably fixed on a ground plane and an array antenna is easily formed to adjust antenna characteristics.

A third object of the present invention is to provide a dielectric resonator antenna in which a satellite communication, a satellite broadcasting or a mobile communication is performed by using a circularly polarized wave.

The first object is achieved by the provision of a dielectric resonator antenna, comprising:

- a metal substrate;
- a dielectric resonator arranged on a first side of the metal substrate for radiating an electromagnetic wave according to a signal; and
- a dielectric wave-guiding channel connected with the dielectric resonator and placed on the first side of the metal substrate for feeding the signal to the dielectric resonator.

In the above configuration, when a signal is transmitted to the dielectric resonator through the dielectric wave-guiding channel, the dielectric resonator is resonated, and an electromagnetic wave is radiated from the dielectric resonator. Therefore, the dielectric resonator antenna functions as a wave radiation device. In this case, because the dielectric resonator and the dielectric wave-guiding channel are placed on the same side of the metal substrate, the dielectric resonator antenna can be easily set on an antenna base or an automobile.

The first object is also achieved by the provision of a dielectric resonator antenna comprising:

a feeder circuit for feeding a signal;

a metal feeding screw connected with the feeder circuit, a length of the metal feeding screw being adjustable; and a dielectric resonator, having a screw hole in which the metal feeding screw is fixedly inserted, for resonating an electromagnetic wave at a resonance frequency depending on the length of the metal feeding screw and radiating an electromagnetic wave according to the signal transmitted from the feeder circuit through the metal feeding screw.

In the above configuration, when a signal fed from the feeder circuit is transmitted to the dielectric resonator through the metal feeding screw, the dielectric resonator is resonated at a resonance frequency depending on the length of the metal feeding screw, and an electromagnetic wave according to the signal is radiated from the dielectric resonator. Therefore, the dielectric resonator antenna functions as a wave radiation device. In this case, because the metal feeding screw is tightly inserted in the screw hole of the dielectric resonator, the dielectric resonator is fixedly connected with the feeder circuit. Also, because a length of the metal feeding screw is adjustable, a resonance frequency of the dielectric resonator antenna for the electromagnetic wave depending on the length of the metal feeding screw can be adjusted.

Accordingly, because the dielectric resonator and the metal feeding screw are arranged on the feeder circuit, the dielectric resonator antenna can be easily set on an antenna base or an automobile. Also, because a length of the metal feeding screw is adjustable, the resonance frequency of the dielectric resonator antenna for the electromagnetic wave can be easily adjusted.

The second object is achieved by the provision of a dielectric resonator antenna comprising:

a metal substrate;

a dielectric resonator arranged on the metal substrate;

a signal feeder for feeding a signal in the dielectric resonator to induce an electric field in the dielectric resonator in a one-sided distribution of the electric field; and fixing means contacting with a rarefactional portion of the dielectric resonator, in which an intensity of the electric field is low, to fix the dielectric resonator to the metal substrate.

In the above configuration, when a signal transmitting through the signal feeder is fed in the dielectric resonator, the dielectric resonator is resonated, an electric field is induced in the dielectric resonator, and an electromagnetic wave is radiated from the dielectric resonator. Therefore, the dielectric resonator antenna functions as a wave radiation device. In this case, the electric field is not uniformly distributed but the intensity of the electric field is one-sided in the dielectric resonator.

Also, a rarefactional portion of the dielectric resonator in which an intensity of the electric field is low is fixed by the fixing means, so that the dielectric resonator is tightly fixed to the metal substrate by the fixing means. To prevent an adverse influence of the fixing means on the electric field, the fixing means is arranged to contact with the rarefactional portion of the dielectric resonator in which the intensity of the electric field is low.

Accordingly, the dielectric resonator can be tightly fixed to the metal substrate by the fixing means while preventing an adverse influence of the fixing means on the electric field.

The second object is also achieved by the provision of a dielectric resonator antenna comprising:

a feeder circuit substrate having a conductive film on its upper surface;

a solid dielectric resonator for radiating an electromagnetic wave according to a signal;

a dielectric film arranged on the upper surface of the feeder circuit substrate to fix the solid dielectric resonator to the feeder circuit substrate;

a microstrip feeding line arranged on a lower surface of the feeder circuit substrate for transmitting the signal to the solid dielectric resonator; and a signal feeding slot arranged in the conductive film of the feeder circuit substrate and placed just under the solid dielectric resonator.

In the above configuration, a signal transmitting through the microstrip feeding line is fed to the solid dielectric resonator through the signal feeding slot, the solid dielectric resonator is resonated, and an electromagnetic wave is radiated from the solid dielectric resonator. Therefore, the dielectric resonator antenna functions as a wave radiation device. In this case, because the solid dielectric resonator is fixed to the feeder circuit substrate by the dielectric film, the signal transmitting through the microstrip feeding line can be reliably fed to the solid dielectric resonator.

The second object is also achieved by the provision of a dielectric resonator antenna comprising:

a dielectric film;

a patterned circuit arranged on a lower surface of the dielectric film for transmitting a signal;

a conductive substrate arranged on an upper surface of the dielectric film to arrange a signal feeding slot on the upper surface of the dielectric film; and a solid dielectric resonator arranged on the conductive substrate for radiating an electromagnetic wave according to the signal transmitting through the patterned circuit and the signal feeding slot.

In the above configuration, conductive layers represented by the patterned circuit and the conductive substrate and dielectric layers represented by the dielectric film and the solid dielectric resonator are alternately arranged. In this case, because the adhesive between the conductive and dielectric layers is strong, the solid dielectric resonator and the conductive substrate are tightly connected, and the conductive substrate and the dielectric film are tightly connected. Therefore, the solid dielectric resonator can be tightly fixed to the dielectric film, and the signal can be reliably fed to the solid dielectric resonator.

The third object is achieved by the provision of a dielectric resonator antenna comprising:

a solid dielectric resonator having a first equivalent length for a first electric field induced in a first direction and a second equivalent length for a second electric field induced in a second direction perpendicular to the first direction on condition that the first equivalent length is shorter than the second equivalent length to set a phase difference between the first and second electric fields to an angle of 90 degrees; and signal feeding means for feeding a signal in the solid dielectric resonator to induce the first and second electric fields.

In the above configuration, when a signal is fed in the solid dielectric resonator by the signal feeding means, a first electric field directed in a first direction is induced in the solid dielectric resonator, and a second electric field directed in a second direction perpendicular to the first direction is induced in the solid dielectric resonator. In this case, because a first equivalent length of the solid dielectric resonator for the first electric field is shorter than a second equivalent length of the solid dielectric resonator for the second electric field, a first phase of the first electric phase differs from a second phase of the second electric phase, and a phase difference between the first and second electric fields becomes an angle of 90 degrees. Therefore, a circularly polarized electromagnetic wave is radiated from the solid dielectric resonator.

Accordingly, the dielectric resonator antenna can function as a radiation device for radiating a circularly polarized electromagnetic wave.

BRIEF DESCRIPTION OF THE DRAWINGS

The objects, features and advantages of the present invention will be apparent from the following description taken in conjunction with the accompanying drawings, in which.

DETAIL DESCRIPTION OF THE EMBODIMENTS

Preferred embodiments of a hemispherical dielectric resonator antenna according to the present invention are described with reference to drawings.

First Embodiment

Figure 1A:
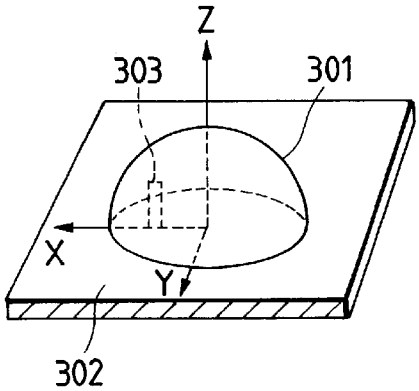
FIG. 1A PRIOR ART
FIG. 1A is an oblique view of a conventional hemispherical dielectric resonator antenna.
Figure 1B:
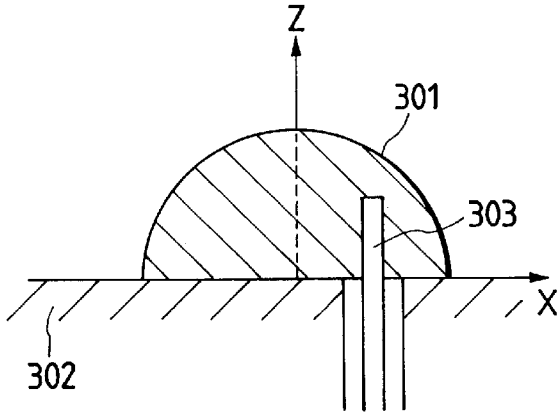
FIG. 1B PRIOR ART
FIG. 1B is a cross sectional view of a hemispherical dielectric resonator shown in FIG. 1A.
Figure 2:
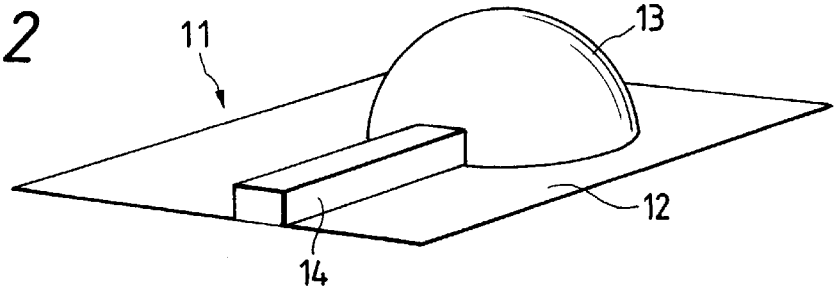
FIG. 2 is an oblique view of a dielectric resonator antenna according to a first embodiment of the present invention.
Figure 3:
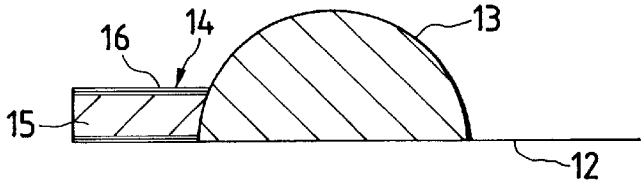
FIG. 3 is a cross-sectional view of the dielectric resonator antenna shown in FIG. 2.

FIG. 2 is an oblique view of a dielectric resonator antenna according to a first embodiment of the present invention, and FIG. 3 is a cross-sectional view of the dielectric resonator antenna shown in FIG. 2.

As shown in FIGS. 2 and 3, a dielectric resonator antenna 11 comprises a metal substrate 12, a hemispherical dielectric resonator 13 arranged on the metal substrate 12 to make a flat surface of the hemispherical dielectric resonator 13 contact with an upper surface of the metal substrate 12, and a dielectric wave-guiding channel 14 arranged on the upper surface of the metal substrate 12 to connect one end of the dielectric wave-guiding channel 14 with a curved side surface portion of the hemispherical dielectric resonator 13. The hemispherical dielectric resonator 13 is filled with a dielectric material. The dielectric wave-guiding channel 14 comprises an inner dielectric body 15 and an outer conductive layer 16 covering upper and side surfaces of the inner dielectric body 15.

In the above configuration, when an input signal transmitting through the dielectric wave-guiding channel 14 is fed from a curved side surface portion of the hemispherical dielectric resonator 13 into the resonator 13, the hemispherical dielectric resonator 13 is resonated in a TE111 mode for a TE (transverse electric) wave, and an electromagnetic wave is radiated from the hemispherical dielectric resonator 13. Therefore, the dielectric resonator antenna 11 functions as a radiating device.

In this case, because the hemispherical dielectric resonator 13 and the dielectric wave-guiding channel 14 are arranged on the same surface of the metal substrate 12, the dielectric resonator antenna 11 can be easily set on an automobile.

Figure 4A:
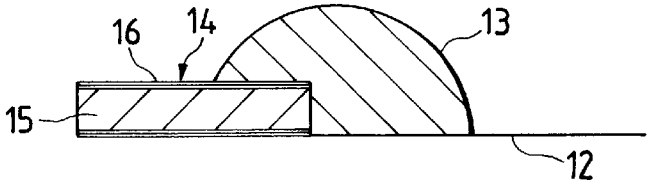
FIGS. 4A and 4B are respectively a cross-sectional view of a dielectric resonator antenna according to a modification of the first embodiment.
Figure 4B:
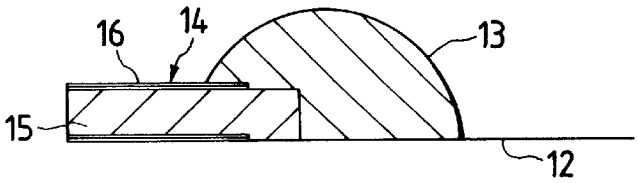

FIGS. 4A and 4B are respectively a cross-sectional view of a dielectric resonator antenna according to a modification of the first embodiment.

As shown in FIG. 4A, a groove is formed in the hemispherical dielectric resonator 13 to tightly insert the dielectric wave-guiding channel 14 into the groove of the hemispherical dielectric resonator 13. In this case, the dielectric wave-guiding channel 14 can be reliably connected with the hemispherical dielectric resonator 13, and the input signal can be reliably fed into the resonator 13.

Also, as shown in FIG. 4B, an end portion of the outer conductive layer 16 inserted into the groove of the hemispherical dielectric resonator 13 is removed from the dielectric wave-guiding channel 14. In this case, because an end portion of the dielectric wave-guiding channel 14 inserted into the groove of the hemispherical dielectric resonator 13 is not covered with the outer conductive layer 16, a portion of the inner dielectric body 15 not covered by the outer conductive layer 16 directly contacts with the hemispherical dielectric resonator 13 in the groove, and a matching condition of the dielectric wave-guiding channel 14 with the hemispherical dielectric resonator 13 can be adjusted. That is, a reflecting characteristic at an contacting plane between the hemispherical dielectric resonator 13 and the dielectric wave-guiding channel 14 is improved, the hemispherical dielectric resonator 13 is strongly resonated, and an intensity of the input signal returned to the dielectric wave-guiding channel 14 is reduced.

Figure 5:
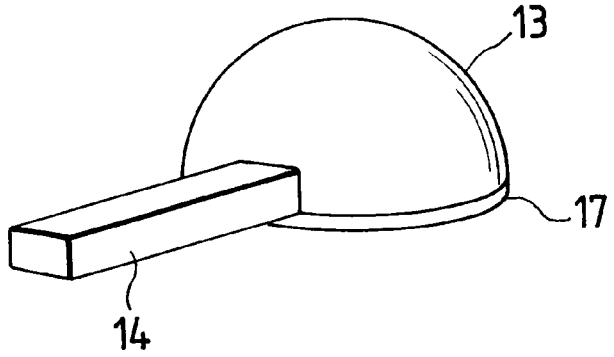
FIG. 5 is an oblique view of a dielectric resonator antenna according to a modification of the first embodiment.

FIG. 5 is an oblique view of a dielectric resonator antenna according to a modification of the first embodiment.

As shown in FIG. 5, the hemispherical dielectric resonator 13 connected with the dielectric wave-guiding channel 14 is arranged on a metal layer 17. A surface shape of the metal layer 17 is the same as a shape of the flat surface of the hemispherical dielectric resonator 13, and the dielectric wave-guiding channel 14 is not placed on the metallic layer 17. Therefore, because the metal layer 17 is used in place of the metal substrate 12, a dielectric resonator antenna comprising the hemispherical dielectric resonator 13, the dielectric wave-guiding channel 14 and the metal layer 17 can be easily set on an automobile by attaching the metal layer 17 on the automobile.

Figure 6:
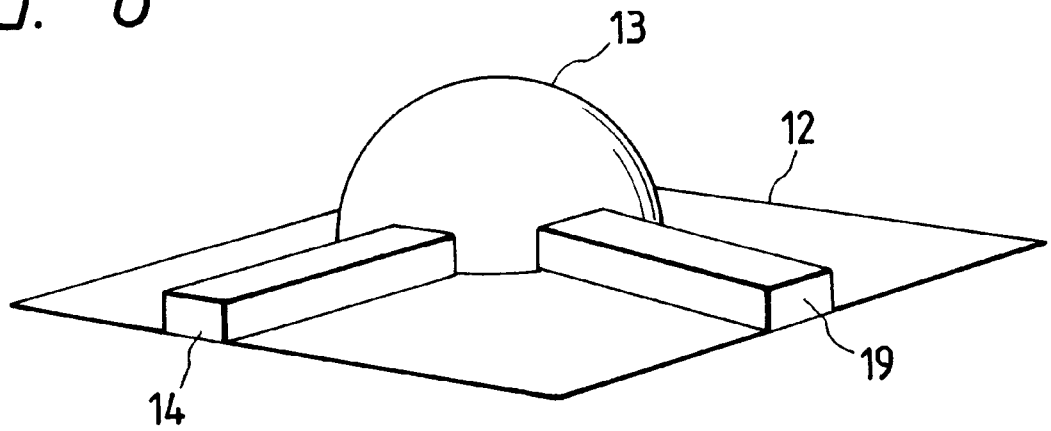
FIG. 6 is an oblique view of a dielectric resonator antenna according to a modification of the first embodiment.

FIG. 6 is an oblique view of a dielectric resonator antenna according to a modification of the first embodiment.

As shown in FIG. 6, a dielectric resonator antenna 18 comprises the metal substrate 12, the hemispherical dielectric resonator 13, the dielectric wave-guiding channel 14, and a secondary dielectric wave-guiding channel 19 arranged on the upper surface of the metal substrate 12 to connect one end of the dielectric wave-guiding channel 19 with another curved side surface portion of the hemispherical dielectric resonator 13. The secondary dielectric wave-guiding channel 19 comprises an inner dielectric body and an outer conductive layer covering upper and side surfaces of the inner dielectric body, in the same manner as the dielectric wave-guiding channel 14. A longitudinal direction of the secondary dielectric wave-guiding channel 19 is perpendicular to that of the dielectric wave-guiding channel 14. Therefore, when a first input signal transmitting through the dielectric wave-guiding channel 14 and a second input signal transmitting through the secondary dielectric wave-guiding channel 19 are simultaneously fed into the resonator 13, the resonators 13 is resonated in two resonance modes orthogonal to each other, and a circularly polarized wave is radiated from the resonator 13. That is, the dielectric resonator antenna 18 functions as a circularly polarized wave antenna.

Accordingly, because the dielectric wave-guiding channel 14 functioning as a signal feeding line is connected with the curved side surface portion of the hemispherical dielectric resonator 13 in the first embodiment, the dielectric wave-guiding channel 14 and the hemispherical dielectric resonator 13 can be formed on the same metal substrate 12.

In the first embodiment, a hemispherical dielectric material is used as the hemispherical dielectric resonator 13. However, the dielectric resonator 13 is not limited to the hemispherical shape. That is, it is applicable that a cylindrical dielectric material, a columnar dielectric material, a semicylindrical dielectric material or a cubical dielectric material be used as a dielectric resonator.

Second Embodiment

Figure 7:
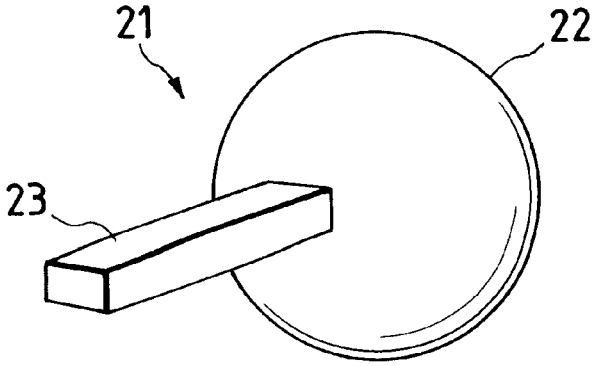
FIG. 7 is an oblique view of a dielectric resonator antenna according to a second embodiment of the present invention.
Figure 8:
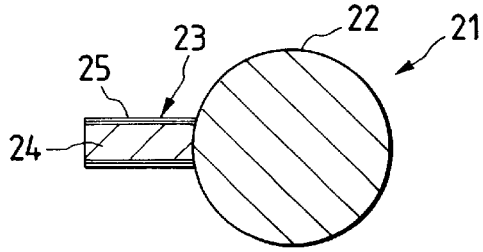
FIG. 8 is a cross-sectional view of the dielectric resonator antenna shown in FIG. 7.

FIG. 7 is an oblique view of a dielectric resonator antenna according to a second embodiment of the present invention, and FIG. 8 is a cross-sectional view of the dielectric resonator antenna shown in FIG. 7.

As shown in FIGS. 7 and 8, a dielectric resonator antenna 21 comprises a spherical dielectric resonator 22, and a dielectric wave-guiding channel 23 of which one end is connected with the spherical dielectric resonator 22. The spherical dielectric resonator 22 is filled with a dielectric material. The dielectric wave-guiding channel 23 comprises an inner dielectric body 24 and an outer conductive layer 25 covering the inner dielectric body 24.

In the above configuration, when an input signal transmitting through the dielectric wave-guiding channel 23 is fed to the spherical dielectric resonator 22, the spherical dielectric resonator 22 is resonated, and an electromagnetic wave is radiated from the spherical dielectric resonator 13. Therefore, the dielectric resonator antenna 21 functions as a radiating device.

Accordingly, because the spherical dielectric resonator 22 is supported by the dielectric wave-guiding channel 23, the spherical dielectric resonator 22 and the dielectric wave-guiding channel 23 can be arranged on the same plane.

Figure 9A:
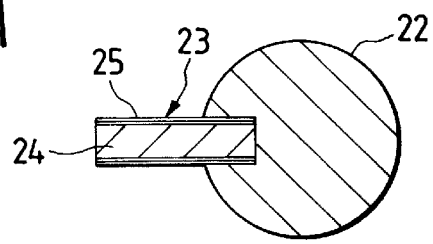
FIGS. 9A and 9B are respectively a cross-sectional view of a dielectric resonator antenna according to a modification of the second embodiment.
Figure 9B:
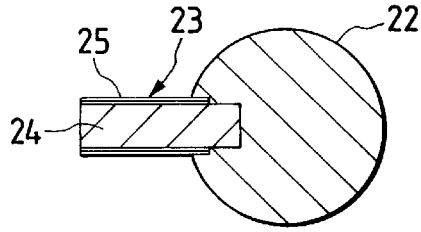

FIGS. 9A and 9B are respectively a cross-sectional view of a dielectric resonator antenna according to a modification of the second embodiment.

As shown in FIG. 9A, a groove is formed in the spherical dielectric resonator 22 to tightly insert the dielectric wave-guiding channel 23 into the groove of the spherical dielectric resonator 22. In this case, the dielectric wave-guiding channel 23 can be reliably connected with the spherical dielectric resonator 22, and the input signal can be reliably fed into the resonator 22.

Also, as shown in FIG. 9B, an end portion of the outer conductive layer 25 inserted into the groove of the spherical dielectric resonator 22 is removed from the dielectric wave-guiding channel 23. In this case, because an end portion of the dielectric wave-guiding channel 23 inserted into the groove of the spherical dielectric resonator 22 is not covered with the outer conductive layer 25, a matching condition of the dielectric wave-guiding channel 23 with the spherical dielectric resonator 22 can be adjusted.

Figure 10:
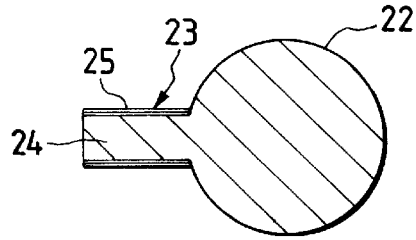
FIG. 10 is a cross-sectional view of a dielectric resonator antenna according to a modification of the second embodiment.

FIG. 10 is a cross-sectional view of a dielectric resonator antenna according to a modification of the second embodiment.

As shown in FIG. 10, the spherical dielectric resonator 22 and the dielectric wave-guiding channel 23 are integrally formed. Therefore, a dielectric material of the spherical dielectric resonator 22 is the same as that of the dielectric wave-guiding channel 23, and the spherical dielectric resonator 22 can be reliably supported by the dielectric wave-guiding channel 23.

Figure 11:
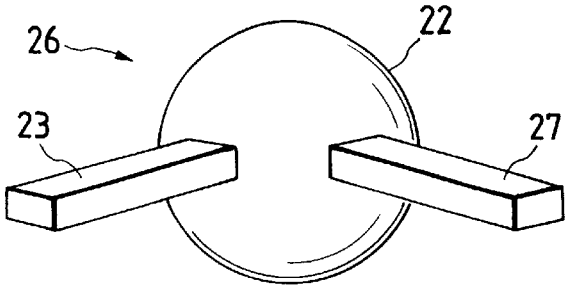
FIG. 11 is an oblique view of a dielectric resonator antenna according to a modification of the second embodiment.

FIG. 11 is an oblique view of a dielectric resonator antenna according to a modification of the second embodiment.

As shown in FIG. 11, a dielectric resonator antenna 26 comprises the spherical dielectric resonator 22, the dielectric wave-guiding channel 23, and a secondary dielectric wave-guiding channel 27 of which one end is connected with the spherical dielectric resonator 22. The secondary dielectric wave-guiding channel 27 comprises an inner dielectric body and an outer conductive layer covering the inner dielectric body, in the same manner as the dielectric wave-guiding channel 23. A longitudinal direction of the secondary dielectric wave-guiding channel 27 is perpendicular to that of the dielectric wave-guiding channel 23. Therefore, a circularly polarized wave is radiated from the resonator 22 in the same manner as in the dielectric resonator antenna 18. That is, the dielectric resonator antenna 26 functions as a circularly polarized wave antenna.

Accordingly, because the dielectric wave-guiding channel 23 functioning as a signal feeding line is connected with the spherical dielectric resonator 22 in the second embodiment, the dielectric wave-guiding channel 23 and the spherical dielectric resonator 22 can be formed on the same plane without using any metal substrate.

In the second embodiment, a spherical dielectric material is used as the spherical dielectric resonator 22. However, the dielectric resonator 22 is not limited to the spherical shape. That is, it is applicable that a cylindrical dielectric material, a semicylindrical dielectric material or a cubical dielectric material be used as a dielectric resonator.

Third Embodiment

Figure 12:
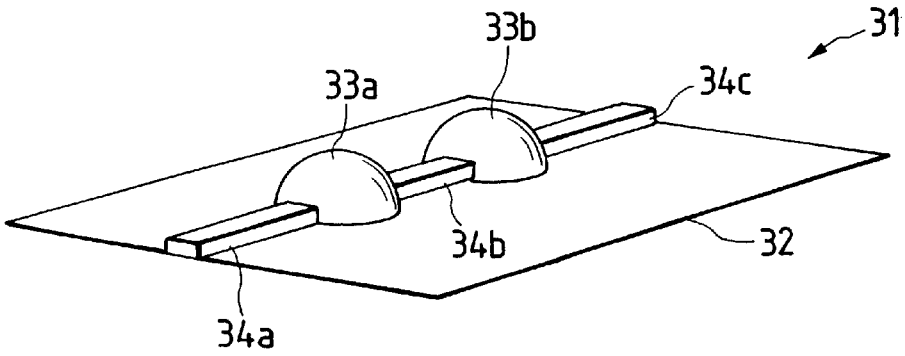
FIG. 12 is an oblique view of a dielectric resonator antenna according to a third embodiment of a portion of the present invention.
Figure 13:
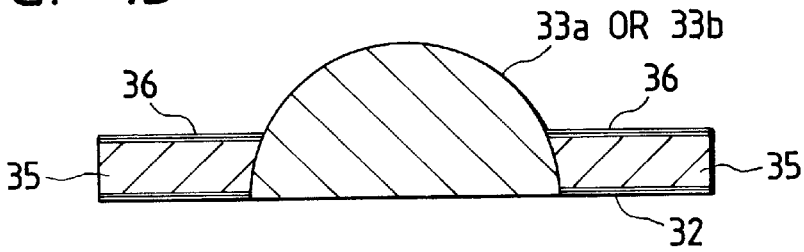
FIG. 13 is a cross-sectional view of the dielectric resonator antenna shown in FIG. 12.

FIG. 12 is an oblique view of a dielectric resonator antenna according to a third embodiment of the present invention, and FIG. 13 is a cross-sectional view of a portion of the dielectric resonator antenna shown in FIG. 12.

As shown in FIGS. 12 and 13, a dielectric resonator antenna 31 comprises a metal substrate 32, a first hemispherical dielectric resonator 33*a* arranged on the metal substrate 32 to make a flat surface of the first hemispherical dielectric resonator 33*a* contact with an upper surface of the metal substrate 32, a second hemispherical dielectric resonator 33*b* arranged on the metal substrate 32 to make a flat surface of the hemispherical dielectric resonator 33*b* contact with the upper surface of the metal substrate 32, a first dielectric wave-guiding channel 34*a* arranged on the upper surface of the metal substrate 32 to connect one end of the first dielectric wave-guiding channel 34*a* with a curved side surface portion of the first hemispherical dielectric resonator 33*a*, a second dielectric wave-guiding channel 34*b* connecting the first and second hemispherical dielectric resonators 33*a* and 33*b* on the upper surface of the metal substrate 32, and a third dielectric wave-guiding channel 34*c* arranged on the upper surface of the metal substrate 32 to connect one end of the third dielectric wave-guiding channel 34*c* with a curved side surface portion of the second hemispherical dielectric resonator 33*b*.

Each of the hemispherical dielectric resonators 33*a* and 33*b* is filled with a dielectric material. Each of the dielectric wave-guiding channels 34*a*, 34*b* and 34*c* comprises an inner dielectric body 35 and an outer conductive layer 36 covering upper and side surfaces of the inner dielectric body 35.

In the above configuration, when an input signal transmitting through the first dielectric wave-guiding channel 34*a* is fed into the first hemispherical dielectric resonator 33*a*, the first hemispherical dielectric resonator 33*a* is resonated in a TE111 mode, and an electromagnetic wave is radiated from the first hemispherical dielectric resonator 33*a*. Also, the input signal is extracted from the first hemispherical dielectric resonator 33*a* to the second dielectric wave-guiding channel 34*b* and is fed into the second hemispherical dielectric resonator 33*b*, and the second hemispherical dielectric resonator 33*b* is resonated in a TE111 mode. Thereafter, an electromagnetic wave is radiated from the second hemispherical dielectric resonator 33*b*, and the input signal is extracted from the second hemispherical dielectric resonator 33*b* to the third dielectric wave-guiding channel 34*c*. Thereafter, the input signal is output or fed into another hemispherical dielectric resonator (not shown). Therefore, the dielectric resonator antenna 31 functions as a radiating device.

Accordingly, because the hemispherical dielectric resonators 33*a* and 33*b* and the dielectric wave-guiding channels 34*a*, 34*b* and 34*c* are arranged on the same surface of the metal substrate 32, the dielectric resonator antenna 31 can be easily set on an automobile.

Figure 14A:
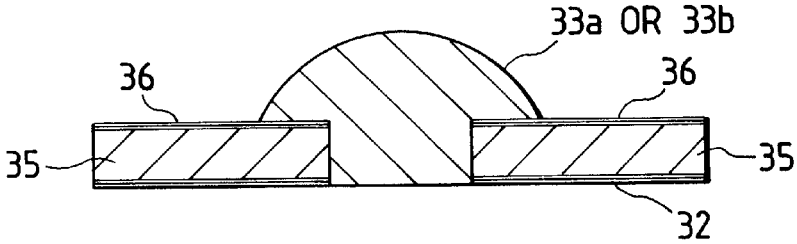
FIGS. 14A and 14B are respectively a cross-sectional view of a dielectric resonator antenna according to a modification of the third embodiment.
Figure 14B:
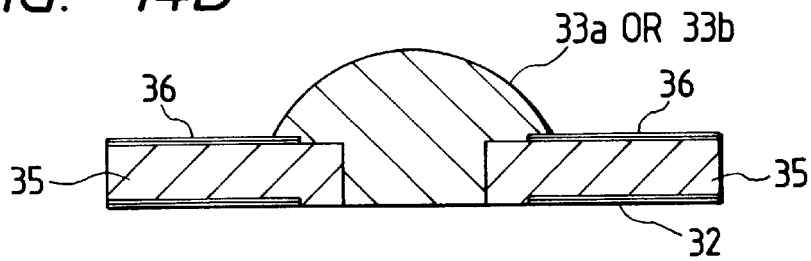

FIGS. 14A and 14B are respectively a cross-sectional view of a dielectric resonator antenna according to a modification of the third embodiment.

As shown in FIG. 14A, a groove is formed in each of the hemispherical dielectric resonators 33*a* and 33*b* to tightly insert each of the dielectric wave-guiding channels 34*a*, 34*b* and 34*c* into the groove of each of the hemispherical dielectric resonators 33*a* and 33*b*. In this case, each of the dielectric wave-guiding channels 34*a*, 34*b* and 34*c* can be reliably connected with each of the hemispherical dielectric resonators 33*a* and 33*b*, and the input signal can be reliably fed into the resonators 33*a* and 33*b*.

Also, as shown in FIG. 14B, an end portion of the outer conductive layer 36 inserted into the groove of each of the hemispherical dielectric resonators 33*a* and 33*b* is removed from each of the dielectric wave-guiding channels 34*a*, 34*b* and 34*c*. In this case, because an end portion of each of the dielectric wave-guiding channels 34*a*, 34*b* and 34*c* inserted into the groove of each of the hemispherical dielectric resonators 33*a* and 33*b* is not covered with the outer conductive layer 36, a matching condition of each of the dielectric wave-guiding channels 34*a*, 34*b* and 34*c* with each of the hemispherical dielectric resonators 33*a* and 33*b* can be adjusted.

In the third embodiment, a hemispherical dielectric material is used as each of the hemispherical dielectric resonator 33*a* and 33*b*. However, the dielectric resonators 33*a* and 33*b* are not limited to the spherical shape. That is, it is applicable that a cylindrical dielectric material, a semicylindrical dielectric material or a cubical dielectric material be used as a dielectric resonator.

Also, it is applicable that the metal layer 17 be arranged just under each of the hemispherical dielectric resonators 33*a* and 33*b* in place of the metal substrate 32.

Fourth Embodiment

Figure 15:
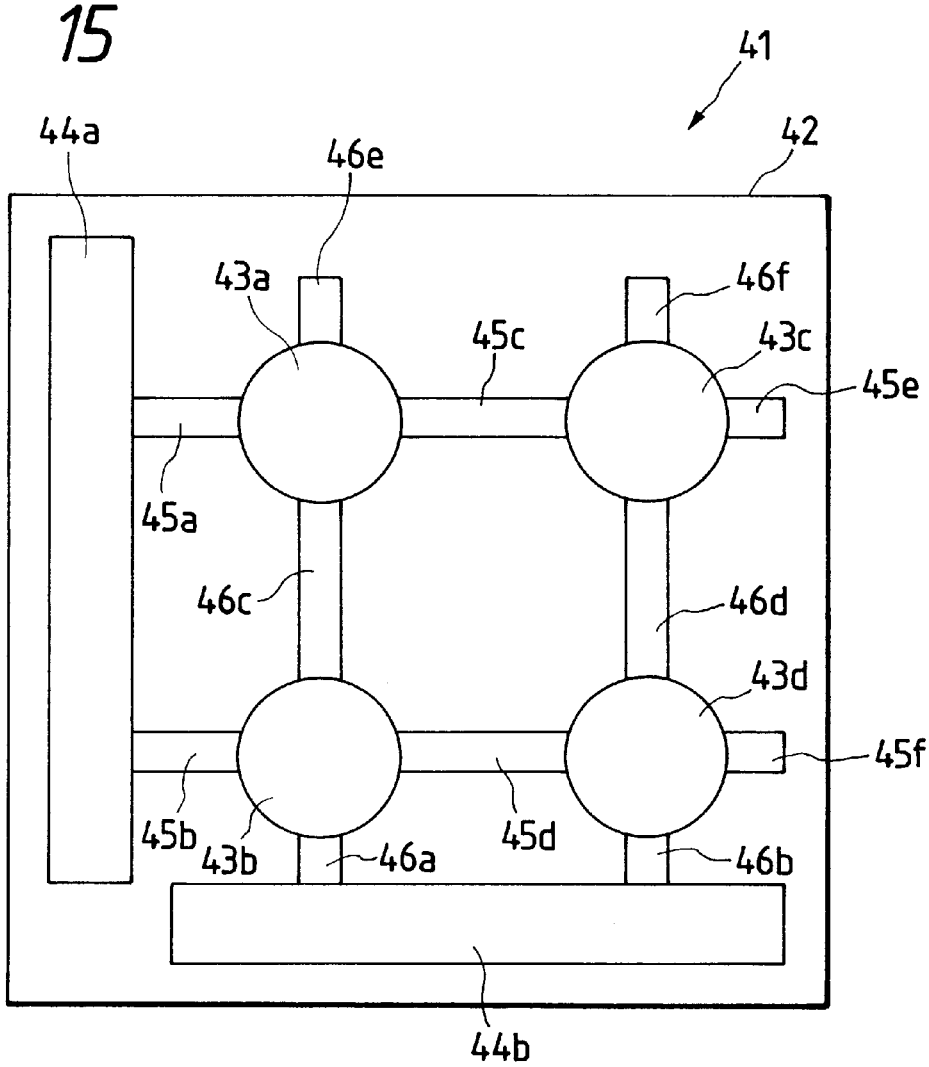
FIG. 15 is a plan view of a dielectric resonator antenna according to a fourth embodiment of the present invention.

FIG. 15 is a plan view of a dielectric resonator antenna according to a fourth embodiment of the present invention.

As shown in FIG. 15, a dielectric resonator antenna 41 comprises a metal substrate 42, a plurality of hemispherical dielectric resonators 43*a* to 43*d* arranged on the metal substrate 42 to make a flat surface of each of the hemispherical dielectric resonators 43*a* to 43*d* contact with an upper surface of the metal substrate 42, a pair of feeder circuits 44*a* and 44*b* for respectively feeding an input signal to the hemispherical dielectric resonators 43*a* to 43*d*, a pair of dielectric wave-guiding channels 45*a* and 45*b* arranged on the upper surface of the metal substrate 42 to connect the feeder circuit 44*a* and curved side surface portions of the hemispherical dielectric resonators 43*a* and 43*b*, a pair of dielectric wave-guiding channels 45*c* and 45*d* arranged on the upper surface of the metal substrate 42 to connect the hemispherical dielectric resonators 43*a* and 43*b* and the hemispherical dielectric resonators 43*c* and 43*d*, a pair of dielectric wave-guiding channels 45*e* and 45*f* connected with curved side surface portions of the hemispherical dielectric resonators 43*c* and 43*d* on the upper surface of the metal substrate 42, a pair of dielectric wave-guiding channels 46*a* and 46*b* arranged on the upper surface of the metal substrate 42 to connect the feeder circuit 44*b* and curved side surface portions of the hemispherical dielectric resonators 43*b* and 43*d*, a pair of dielectric wave-guiding channels 46*c* and 46*d* arranged on the upper surface of the metal substrate 42 to connect the hemispherical dielectric resonators 43*b* and 43*d* and the hemispherical dielectric resonators 43*a* and 43*c*, and a pair of dielectric wave-guiding channels 46*e* and 46*f* connected with curved side surface portions of the hemispherical dielectric resonators 43*a* and 43*c* on the upper surface of the metal substrate 42.

Each of the dielectric wave-guiding channels 45*a* to 45*f* extends in a first direction, and each of the dielectric wave-guiding channels 46*a* to 46*f* extends in a second direction perpendicular to the first direction. Each of the dielectric wave-guiding channels 45*a* to 45*f* and 46*a* to 46*f* comprises an inner dielectric body and an outer conductive layer covering upper and side surfaces of the inner dielectric body.

In the above configuration, when a first input signal is fed from the feeder circuit 44*a* to the hemispherical dielectric resonators 43*a* and 43*b* through the dielectric wave-guiding channels 45*a* and 45*b*, the hemispherical dielectric resonators 43*a* and 43*b* are respectively resonated in a first resonance mode. Thereafter, the first input signal is extracted from each of the hemispherical dielectric resonators 43*a* and 43*b* and is fed to the hemispherical dielectric resonators 43*c* and 43*d* through the dielectric wave-guiding channels 45*c* and 45*d*, and the hemispherical dielectric resonators 43*c* and 43*d* are respectively resonated in the same first resonance mode. Thereafter, the first input signal is extracted from each of the hemispherical dielectric resonators 43*c* and 43*d* and is output or fed to another pair of hemispherical dielectric resonators (not shown) through the dielectric wave-guiding channels 45*e* and 45*f*.

Also, a second input signal is fed from the feeder circuit 44*b* to the hemispherical dielectric resonators 43*b* and 43*d* through the dielectric wave-guiding channels 46*a* and 46*b* at the same time that the first input signal is fed to the hemispherical dielectric resonators 43*a* and 43*b*. Therefore, the hemispherical dielectric resonators 43*b* and 43*d* are respectively resonated in a second resonance mode orthogonal to the first resonance mode. Thereafter, the second input signal is extracted from each of the hemispherical dielectric resonators 43*b* and 43*d* and is fed to the hemispherical dielectric resonators 43*a* and 43*c* through the dielectric wave-guiding channels 46*c* and 46*d*, and the hemispherical dielectric resonators 43*a* and 43*c* are respectively resonated in the same second resonance mode. Thereafter, the second input signal is extracted from each of the hemispherical dielectric resonators 43*a* and 43*c* and is output or fed to another pair of hemispherical dielectric resonators (not shown) through the dielectric wave-guiding channels 46*e* and 46*f*.

In each of the hemispherical dielectric resonators 43*a* to 43*d* resonated in the first and second resonance modes orthogonal to each other by the first and second input signals, a circularly polarized wave is radiated. Therefore, the dielectric resonator antenna 41 functions as a radiation device for the circularly polarized wave.

Accordingly, because the hemispherical dielectric resonators 43*a* to 43*d* arranged on the metal substrate 42 are connected by the dielectric wave-guiding channels 45*a* to 45*f* extending in the first direction and the dielectric wave-guiding channels 46*a* to 46*f* extending in the second direction perpendicular to the first direction on the metal substrate 42, the hemispherical dielectric resonators 43*a* to 43*d* are respectively resonated in the first and second resonance modes orthogonal to each other. Therefore, the hemispherical dielectric resonators 43*a* to 43*d* and the dielectric wave-guiding channels 45*a* to 45*f* and 46*a* to 46*f* of the dielectric resonator antenna 41 can be arranged on the same plane, and the circularly polarized wave can be radiated from the dielectric resonator antenna 41.

Fifth Embodiment

Figure 16:
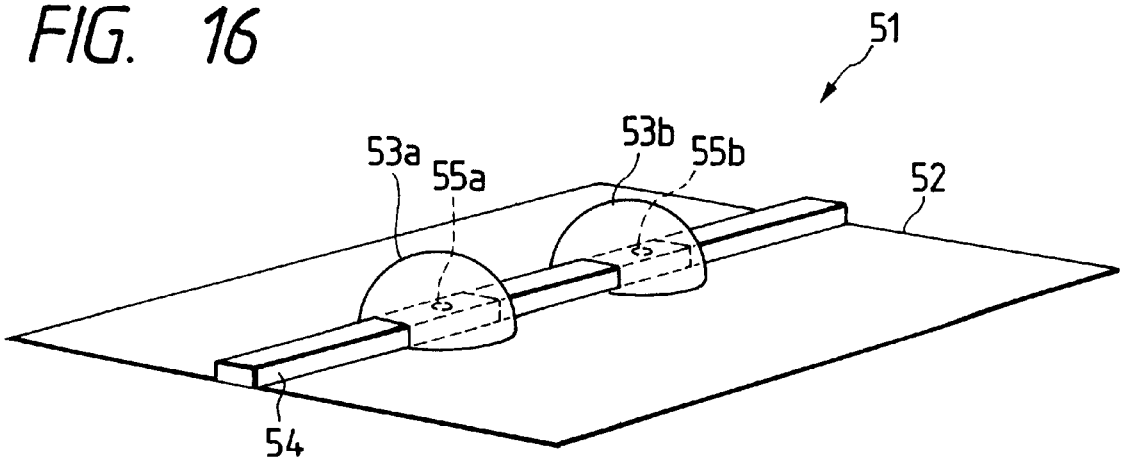
FIG. 16 is an oblique view of a dielectric resonator antenna according to a fifth embodiment of the present invention.

FIG. 16 is an oblique view of a dielectric resonator antenna according to a fifth embodiment of the present invention.

As shown in FIG. 16, a dielectric resonator antenna 51 comprises a metal substrate 52, a plurality of hemispherical dielectric resonators 53*a* and 53*b* arranged on the metal substrate 52 to make a flat surface of each of the hemispherical dielectric resonators 53*a* and 53*b* contact with an upper surface of the metal substrate 52, a dielectric wave-guiding channel 54 which is arranged on the metal substrate 52 and penetrates through a groove of each of the hemispherical dielectric resonators 53*a* and 53*b*.

The dielectric wave-guiding channel 54 comprises an inner dielectric body and an outer conductive layer which covers upper and side surfaces of the inner dielectric body and has a pair of signal feeding slots 55*a* and 55*b* to expose the inner dielectric body to the hemispherical dielectric resonators 53*a* and 53*b*. That is, the signal feeding slots 55*a* and 55*b* are placed just under the hemispherical dielectric resonators 53*a* and 53*b*.

Also, because the groove formed in a flat surface portion of each of the hemispherical dielectric resonator 53*a* and 53*b* extends from one curved side surface to another curved side surface of each resonator, the dielectric wave-guiding channel 54 arranged on the metal substrate 52 is tightly inserted in each of the hemispherical dielectric resonators 53*a* and 53*b* and penetrates through each of the resonators 53*a* and 53*b*.

In the above configuration, when an input signal transmits through the dielectric wave-guiding channel 54, the input signal is fed to the hemispherical dielectric resonators 53*a* and 53*b* though the signal feeding slots 55*a* and 55*b* because the inner dielectric body of the dielectric wave-guiding channel 54 is exposed to the resonator 53*a* and 53*b* though the signal feeding slots 55*a* and 55*b*. Therefore, the resonator 53*a* and 53*b* are resonated, and an electromagnetic wave is radiated from each of the resonator 53*a* and 53*b*.

Accordingly, because the hemispherical dielectric resonators 53*a* and 53*b* are connected by the dielectric wave-guiding channel 54, the dielectric resonator antenna 51 having the hemispherical dielectric resonators 53*a* and 53*b* and the dielectric wave-guiding channel 54 arranged on the same plane can functions as a radiation device.

Sixth Embodiment

Figure 17:
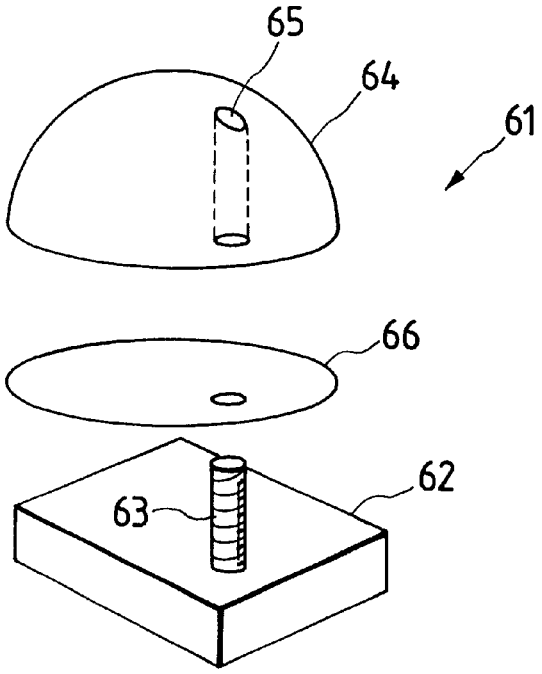
FIG. 17 is an exploded oblique view of a dielectric resonator antenna according to a sixth embodiment of the present invention.
Figure 18:
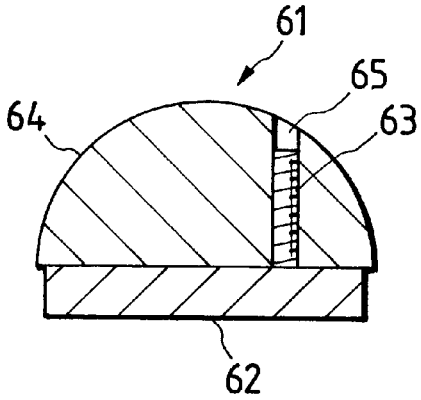
FIG. 18 is a cross-sectional view of the dielectric resonator antenna shown in FIG. 17.

FIG. 17 is an exploded oblique view of a dielectric resonator antenna according to a sixth embodiment of the present invention, and FIG. 18 is a cross-sectional view of the dielectric resonator antenna shown in FIG. 17.

As shown in FIGS. 17 and 18, a dielectric resonator antenna 61 comprises a feeder circuit 62, a metal feeding screw 63 electrically and mechanically connected with the feeder circuit 62, a hemispherical dielectric resonator 64 which has a screw hole 65 and is fixedly connected with the feeder circuit 62 though the metal feeding screw 63 inserted in the screw hole 65, and a metal layer 66 placed between the feeder circuit 62 and the hemispherical dielectric resonator 64. The hemispherical dielectric resonator 64 is supported by the metal feeding screw 63 tightly inserted in the screw hole 65.

In the above configuration, an input signal is fed from the feeder circuit 62 to the hemispherical dielectric resonator 64 through the metal feeding screw 63, the hemispherical dielectric resonator 64 is resonated, and an electromagnetic wave is radiated from the resonator 64. In this case, when a length of the metal feeding screw 63 projected from the feeder circuit 62 is adjusted by screwing the metal feeding screw 63, a resonance frequency of the hemispherical dielectric resonator 64 and an input impedance of the hemispherical dielectric resonator 64 change.

Accordingly, resonance conditions of the resonance frequency and the input impedance can be adjusted, and a frequency of the dielectric resonator antenna for the electromagnetic wave can be adjusted.

Figure 19:
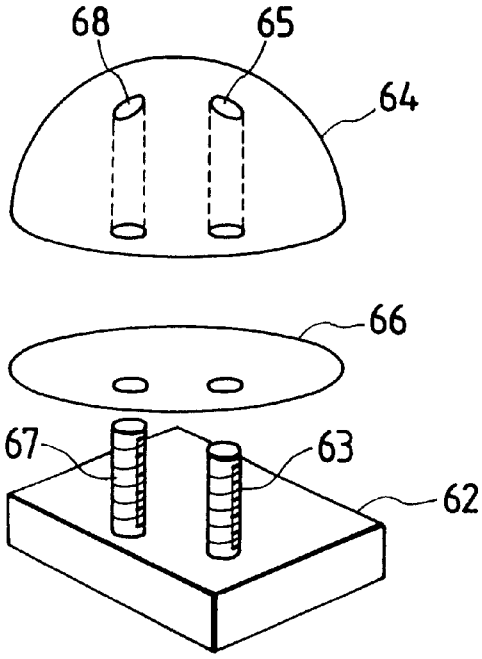
FIG. 19 is an exploded oblique view of a dielectric resonator antenna according to a modification of the sixth embodiment.

In the sixth embodiment, the metal feeding screw 63 is only arranged in the dielectric resonator antenna 61, and a linearly polarized wave is radiated. However, as shown in FIG. 19, it is applicable that another metal feeding screw 67 tightly inserted in another screw hole 68 of the hemispherical dielectric resonator 64 be additionally arranged in the dielectric resonator antenna 61 to resonate the hemispherical dielectric resonator 64 in two resonance modes orthogonal to each other. In this case, a circularly polarized wave is radiated from the dielectric resonator antenna 61.

Seventh Embodiment

Figure 20:
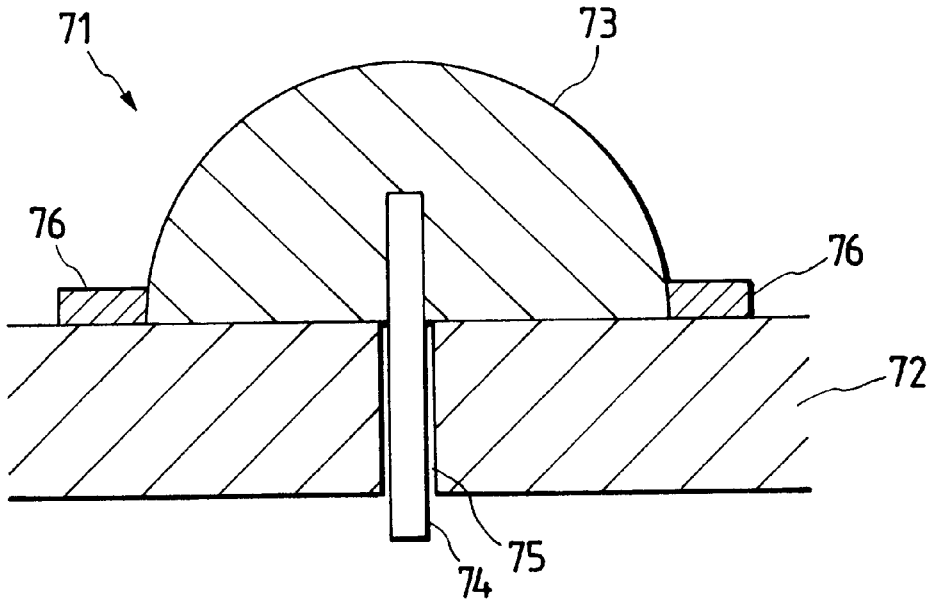
FIG. 20 is a cross-sectional view of a dielectric resonator antenna according to a seventh embodiment of the present invention.
Figure 21:
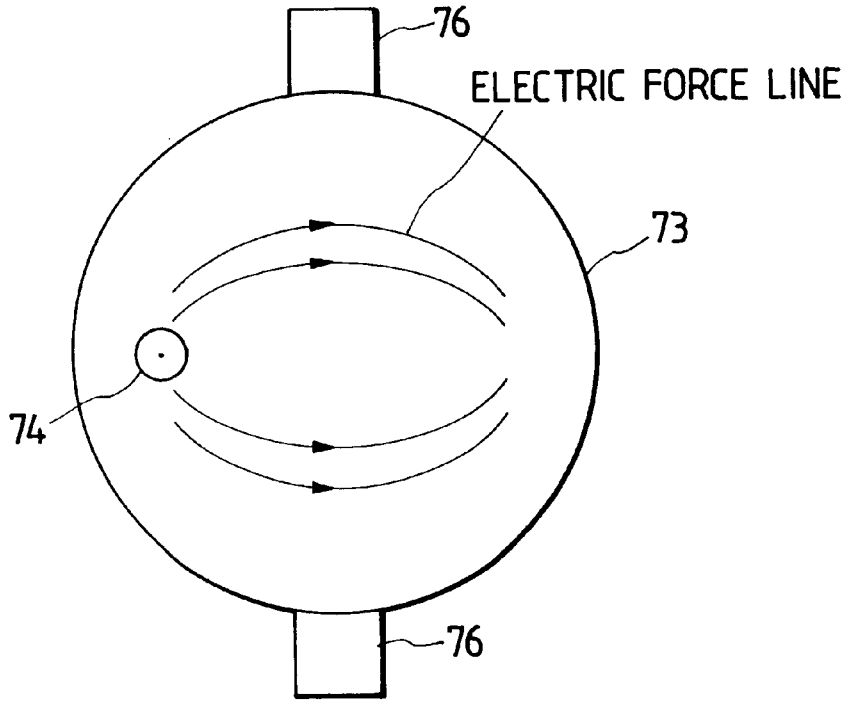
FIG. 21 is a plan view of the dielectric resonator antenna shown in FIG. 20 to schematically show electric force lines occurring in a hemispherical dielectric resonator.

FIG. 20 is a cross-sectional view of a dielectric resonator antenna according to a seventh embodiment of the present invention, and FIG. 21 is a plan view of the dielectric resonator antenna shown in FIG. 20 to schematically show electric force lines occurring in a hemispherical dielectric resonator.

As shown in FIG. 20, a dielectric resonator antenna 71 comprises a grounded conductive substrate 72, a hemispherical dielectric resonator 73 which is filled with a first dielectric material and is arranged on the grounded conductive substrate 72 to make a flat surface of the hemispherical dielectric resonator 73 contact with an upper surface of the grounded conductive substrate 72, a coaxial feeder 74 inserted in a feeder hole of the hemispherical dielectric resonator 73 through a through-hole 75 of the grounded conductive substrate 72, and a pair of fixing blocks 76 made of a second dielectric material for fixedly setting the hemispherical dielectric resonator 73 on the grounded conductive substrate 72.

The fixing blocks 76 is fixedly arranged on the grounded conductive substrate 72 before the hemispherical dielectric resonator 73 is arranged on the grounded conductive substrate 72. A relative dielectric constant of the second dielectric material of the fixing blocks 76 considerably differs from that of the first dielectric material of the hemispherical dielectric resonator 73. That is, the relative dielectric constant of the fixing blocks 76 is lower than that of the hemispherical dielectric resonator 73. The fixing blocks 76 face each other with the hemispherical dielectric resonator 73 between the fixing blocks 76. The coaxial feeder 74 inserted in the hemispherical dielectric resonator 73 is placed at a one-sided position far from the fixing blocks 76.

In the above configuration, the hemispherical dielectric resonator 73 arranged on the grounded conductive substrate 72 is fixed by a friction force occurring between the hemispherical dielectric resonator 73 and each of the fixing blocks 76. Also, As shown in FIG. 21, an electric field is induced in the hemispherical dielectric resonator 73 by resonating the hemispherical dielectric resonator 73 according to an input signal transmitting through the coaxial feeder 74. In this case, because the coaxial feeder 74 is placed at a one-sided position in the hemispherical dielectric resonator 73, an intensity of the electric field is high at a one-sided portion of the hemispherical dielectric resonator 73 adjacent to the coaxial feeder 74, a central portion of the hemispherical dielectric resonator 73 and another portion of the hemispherical dielectric resonator 73 opposite to the one-sided portion in cases where the resonator 73 is resonated in a TE111 resonance mode. Also, the intensity of the electric field is low at particular portions of the hemispherical dielectric resonator 73 contacting with the fixing blocks 76. That is, the particular portions of the hemispherical dielectric resonator 73 contacting with the fixing blocks 76 agree with rarefactional portions of electric force lines.

Accordingly, because the fixing blocks 76 are placed to contact with the rarefactional portions of the electric force lines in the hemispherical dielectric resonator 73 and a relative dielectric constant of the second dielectric material of the fixing blocks 76 considerably differs from that of the first dielectric material of the hemispherical dielectric resonator 73, the dielectric resonator antenna 71 can be reliably fixed on the grounded conductive substrate 72 by the fixing blocks 76 on condition that the resonance of the hemispherical dielectric resonator 73 is not influenced by the fixing blocks 76.

In the seventh embodiment, the fixing blocks 76 are made of the second dielectric material. However, it is applicable that the fixing blocks 76 be made of a material except a metal. Also, it is applicable that the fixing blocks 76 and the grounded conductive substrate 72 are integrally formed. Also, it is applicable that a rubber having a relative dielectric constant which considerably differs from that of the first dielectric material of the hemispherical dielectric resonator 73 be attached on the grounded conductive substrate 72 with an adhesive agent to fix the hemispherical dielectric resonator 73 to the hemispherical dielectric resonator 73 after the hemispherical dielectric resonator 73 is arranged on the grounded conductive substrate 72. Also, it is applicable that a feeder circuit and a microstrip feeding channel be used in place of the coaxial feeder 74.

Eighth Embodiment

Figure 22:
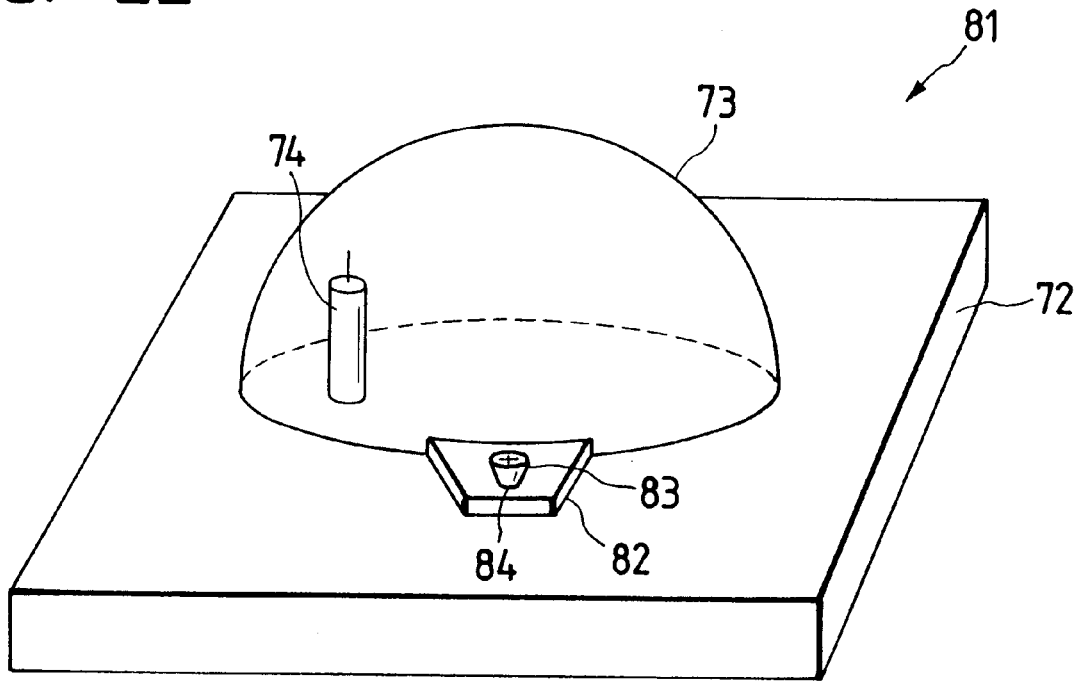
FIG. 22 is an oblique view of a dielectric resonator antenna according to an eighth embodiment of the present invention.

FIG. 22 is an oblique view of a dielectric resonator antenna according to an eighth embodiment of the present invention.

As shown in FIG. 22, a dielectric resonator antenna 81 comprises the grounded conductive substrate 72, the hemispherical dielectric resonator 73, the coaxial feeder 74, a projecting element 82 integrally formed with the hemispherical dielectric resonator 73, and a screw 83 tightly inserted in a screw hole 84 of the projecting element 82 and fixed to the grounded conductive substrate 72.

The projecting element 82 contacts with a particular portion of the hemispherical dielectric resonator 73 in which an intensity of the electric field is low. A relative dielectric constant of the projecting element 82 considerably differs from that of the first dielectric material of the hemispherical dielectric resonator 73. That is, the relative dielectric constant of the projecting element 82 is lower than that of the hemispherical dielectric resonator 73.

To fabricate the dielectric resonator antenna 81, the hemispherical dielectric resonator 73 is fixedly connected with the grounded conductive substrate 72 because the screw 83 tightly connects the projecting element 82 and the grounded conductive substrate 72.

Accordingly, because the projecting element 82 is placed to contact with the particular portion of the hemispherical dielectric resonator 73 in which the intensity of the electric field is low and a relative dielectric constant of the projecting element 82 considerably differs from that of the first dielectric material of the hemispherical dielectric resonator 73, the dielectric resonator antenna 81 can be reliably fixed on the grounded conductive substrate 72 on condition that the resonance of the hemispherical dielectric resonator 73 is not influenced by the projecting element 82.

In the eighth embodiment, the projecting element 82 integrally formed with the hemispherical dielectric resonator 73 is fixed to the grounded conductive substrate 72 by the screw 83. However, it is applicable that a rubber having a relative dielectric constant which considerably differs from that of the first dielectric material of the hemispherical dielectric resonator 73 be attached on the grounded conductive substrate 72 with an adhesive agent to fix the hemispherical dielectric resonator 73 to the hemispherical dielectric resonator 73 after the hemispherical dielectric resonator 73 is arranged on the grounded conductive substrate 72.

Also, it is applicable that a second projecting element be additionally integrally formed with the hemispherical dielectric resonator 73 and be placed at a position opposite to the projecting element 82 with the hemispherical dielectric resonator 73 between the projecting element 82 and the second projecting element.

Also, it is applicable that a feeder circuit and a microstrip feeding channel be used in place of the coaxial feeder 74.

Ninth Embodiment

Figure 23:
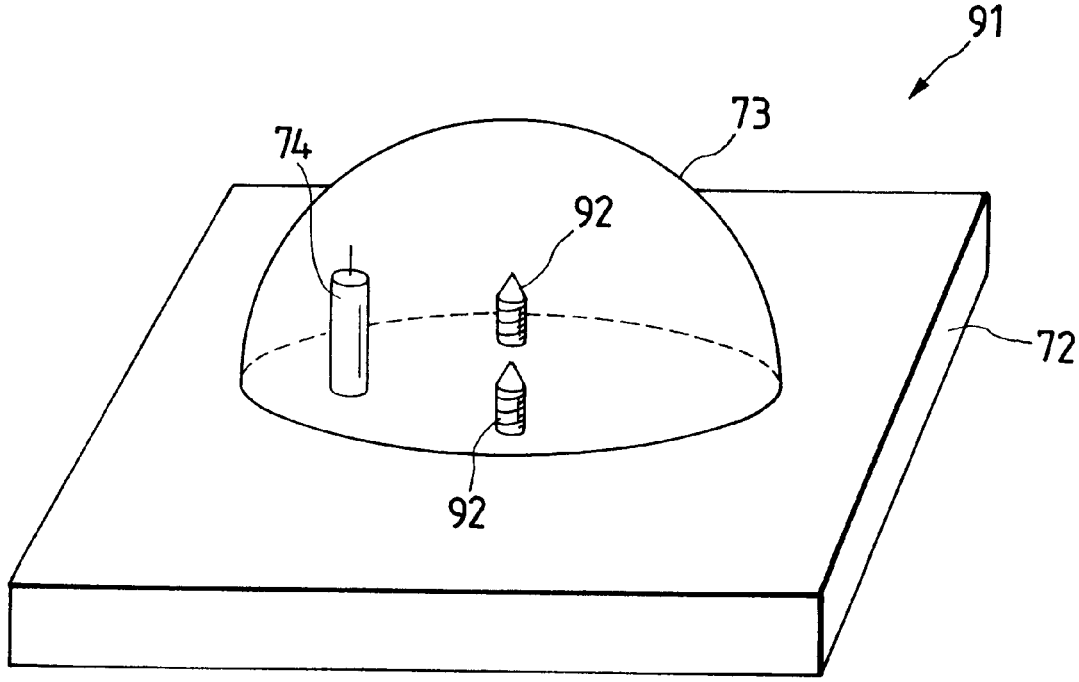
FIG. 23 is an oblique view of a dielectric resonator antenna according to a ninth embodiment of the present invention.

FIG. 23 is an oblique view of a dielectric resonator antenna according to a ninth embodiment of the present invention.

As shown in FIG. 23, a dielectric resonator antenna 91 comprises the grounded conductive substrate 72, the hemispherical dielectric resonator 73, the coaxial feeder 74, and a pair of dielectric screws 92 made of a dielectric material for connecting the hemispherical dielectric resonator 73 and the grounded conductive substrate 72.

The dielectric screws 92 are placed in the particular portion of the hemispherical dielectric resonator 73 in which the intensity of the electric field is low. A length of each of the dielectric screws 92 projecting from the hemispherical dielectric resonator 73 is changeable to change a distribution of an electromagnetic field in the hemispherical dielectric resonator 73. Also, a position of each of the dielectric screws 92 is changeable to change the distribution of the electromagnetic field.

To fabricate the dielectric resonator antenna 91, each of the dielectric screws 92 is tightly inserted in screw holes of the grounded conductive substrate 72 and the hemispherical dielectric resonator 73 from a rear surface of the grounded conductive substrate 72, and a length of each of the dielectric screws 92 projecting from the hemispherical dielectric resonator 73 is adjusted. Therefore, a resonance mode in the hemispherical dielectric resonator 73 is adjusted.

Accordingly, the hemispherical dielectric resonator 73 can be reliably fixed to the grounded conductive substrate 72 on condition that antenna characteristics are changeable in the dielectric resonator antenna 91.

It is applicable that a feeder circuit and a microstrip feeding channel be used in place of the coaxial feeder 74.

Also, it is applicable that each of the dielectric screws 92 be replaced with a dielectric pin.

Tenth Embodiment

Figure 24:
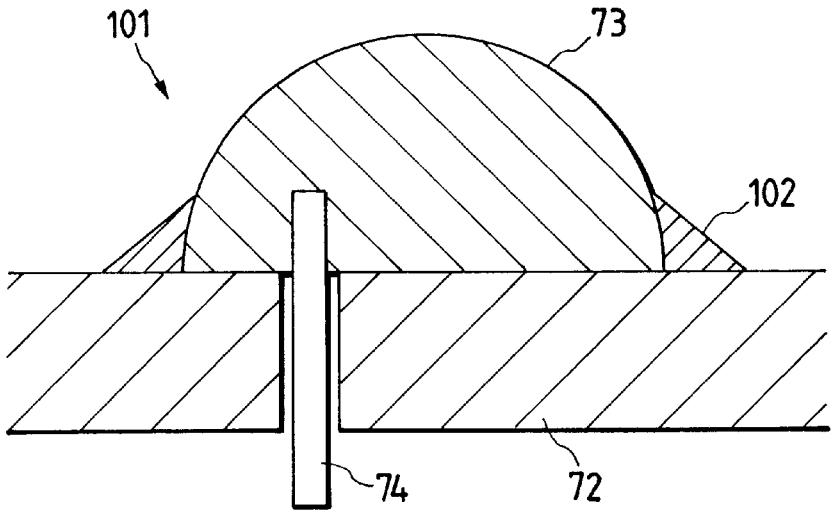
FIG. 24 is a cross-sectional view of a dielectric resonator antenna according to a tenth embodiment of the present invention.

FIG. 24 is a cross-sectional view of a dielectric resonator antenna according to a tenth embodiment of the present invention.

As shown in FIG. 24, a dielectric resonator antenna 101 comprises the grounded conductive substrate 72, the hemispherical dielectric resonator 73, the coaxial feeder 74, and a resin layer 102 arranged around the grounded conductive substrate 72 for fixing the hemispherical dielectric resonator 73 to the grounded conductive substrate 72. A photo-curing type of resin is, for example, used as a material of the resin layer 102.

To fabricate the dielectric resonator antenna 101, a boundary area between the grounded conductive substrate 72 and the hemispherical dielectric resonator 73 is coated with a softened resin, and the softened resin is hardened and is changed to the resin layer 102. Therefore, the hemispherical dielectric resonator 73 is tightly fixed to the grounded conductive substrate 72. In this case, when a relative dielectric constant of the resin layer 102 is changed, an electromagnetic field distribution in the hemispherical dielectric resonator 73 is changed, and a resonance mode in the hemispherical dielectric resonator 73 is changed.

Accordingly, the hemispherical dielectric resonator 73 can be reliably fixed to the grounded conductive substrate 72 on condition that antenna characteristics are changeable in the dielectric resonator antenna 101.

It is applicable that a feeder circuit and a microstrip feeding channel be used in place of the coaxial feeder 74.

Also, it is applicable that a dielectric material gradually hardened be used as a material of the resin layer 102.

Eleventh Embodiment

Figure 25:
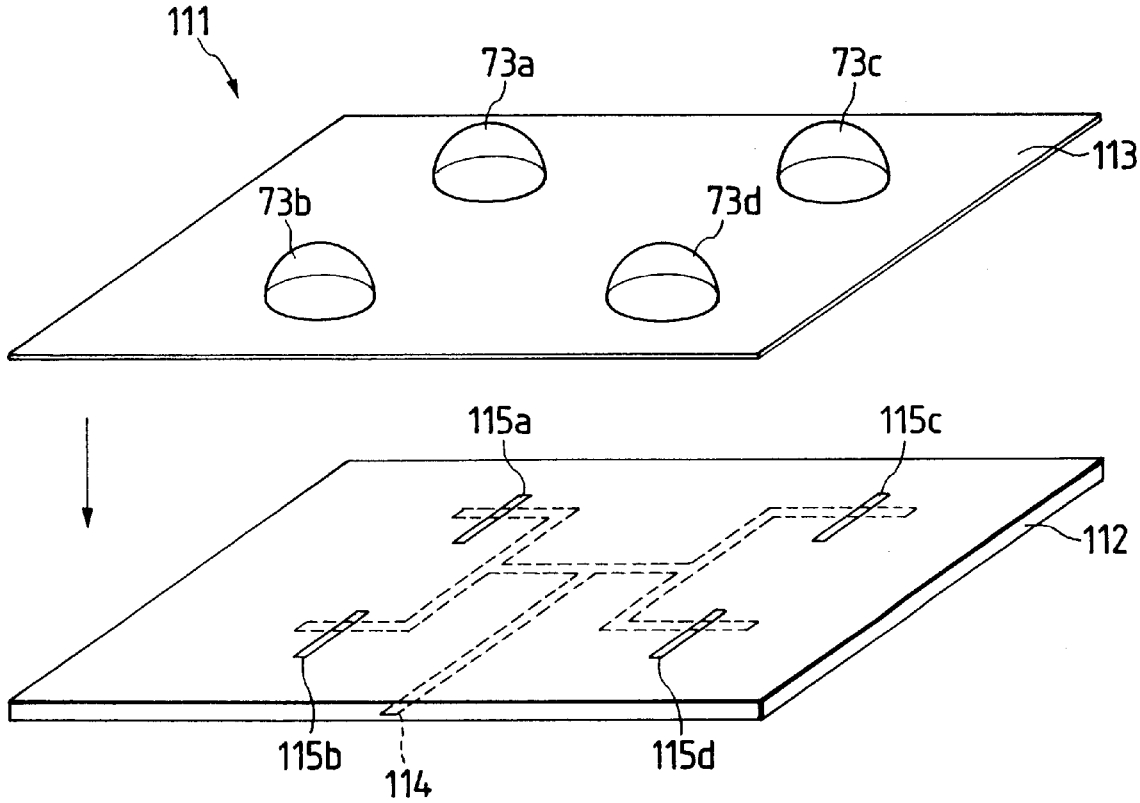
FIG. 25 is an exploded oblique view of a four-device dielectric resonator array antenna according to an eleventh embodiment of the present invention.

FIG. 25 is an exploded oblique view of a four-device dielectric resonator array antenna according to an eleventh embodiment of the present invention.

As shown in FIG. 25, a four-device dielectric resonator array antenna 111 comprises a feeder circuit substrate 112 having a grounded conductive film on its ground surface side, a dielectric film 113 arranged on a ground surface of the feeder circuit substrate 112, four hemispherical dielectric resonators 73*a* to 73*d* arranged on the dielectric film 113, a microstrip feeding line 114 arranged on a rear surface of the feeder circuit substrate 112 for transmitting a plurality of input signals, and four signal feeding slots 115*a* to 115*d* of the feeder circuit substrate 112 placed on the microstrip feeding line 114 and placed just under the hemispherical dielectric resonators 73*a* to 73*d*. The signal feeding slots 115*a* to 115*d* are formed by opening four portions of the grounded conductive film of the feeder circuit substrate 112.

The hemispherical dielectric resonators 73*a* to 73*d* are tightly fixed to the dielectric film 113 and the feeder circuit substrate 112 according to one of the seventh to tenth embodiments.

In the above configuration, when four input signals having the same phase are transmitted through the microstrip feeding line 114 in a transmitting operation, the input signals are fed in the hemispherical dielectric resonators 73*a* to 73*d* through the signal feeding slots 115*a* to 115*d*, and the hemispherical dielectric resonators 73*a* to 73*d* are resonated at the same phase. Thereafter, an electromagnetic wave is radiated from each of the hemispherical dielectric resonators 73*a* to 73*d*. Therefore, the four-device dielectric resonator array antenna 111 functions as an array antenna.

Also, in a receiving operation, each of the hemispherical dielectric resonators 73*a* to 73*d* is resonated by a receiving signal, the receiving signals are transmitted to the microstrip feeding line 114 through the signal feeding slots 115*a* to 115*d* and are combined to a unified receiving signal, and the unified receiving signal is output as a receiving signal.

Accordingly, because the microstrip feeding line 114 is arranged on the feeder circuit substrate 112 and the hemispherical dielectric resonators 73*a* to 73*d* are arranged on the dielectric film 113, an array antenna can be obtained at a low cost.

Twelfth Embodiment

Figure 26:
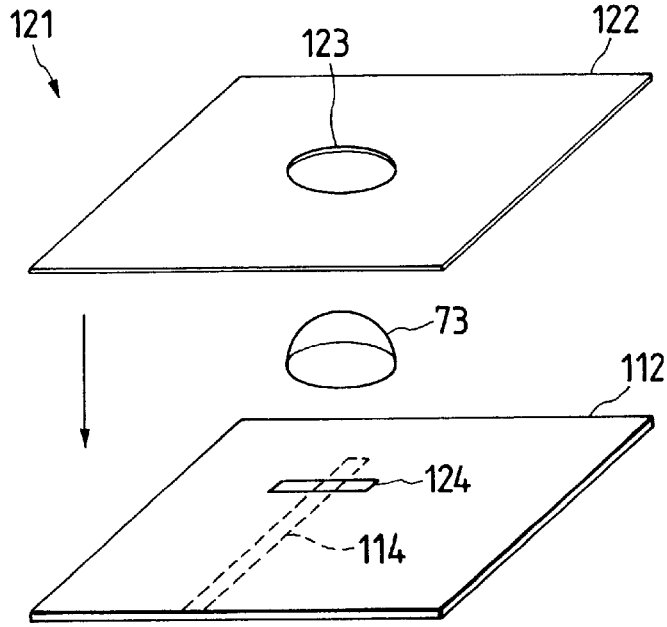
FIG. 26 is an exploded oblique view of a dielectric resonator antenna according to a twelfth embodiment of the present invention.
Figure 27:
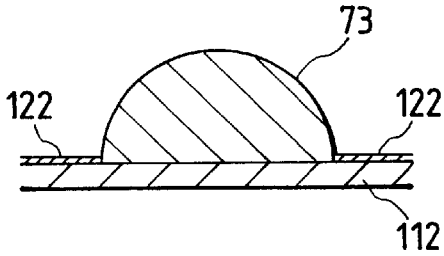
FIG. 27 is a cross-sectional view of the dielectric resonator antenna shown in FIG. 26.

FIG. 26 is an exploded oblique view of a dielectric resonator antenna according to a twelfth embodiment of the present invention, and FIG. 27 is a cross-sectional view of the dielectric resonator antenna shown in FIG. 26.

As shown in FIGS. 26 and 27, a dielectric resonator antenna 121 comprises the feeder circuit substrate 112 having the grounded conductive film on its ground surface side, a dielectric film 122 arranged on the ground surface of the feeder circuit substrate 112, the hemispherical dielectric resonator 73 of which a flat bottom portion is tightly set in a fixing circular hole 123 of the dielectric film 122, the microstrip feeding line 114, and a signal feeding slot 124 of the feeder circuit substrate 112 placed on the microstrip feeding line 114 and placed just under the hemispherical dielectric resonator 73.

In the above configuration, the hemispherical dielectric resonator 73 set in the fixing circular hole 123 is fixed to the dielectric film 122 because of a friction force between the hemispherical dielectric resonator 73 and the dielectric film 122. In this case, a diameter of the fixing circular hole 123 is equal to or slightly lower than that of the hemispherical dielectric resonator 73.

Accordingly, because the hemispherical dielectric resonator 73 is tightly set in the fixing circular hole 123, the dielectric resonator antenna 121 in which the hemispherical dielectric resonator 73 is easily fixed to the dielectric film 122 and the feeder circuit substrate 112 can be obtained.

Figure 28:
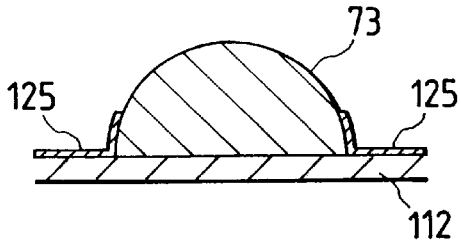
FIG. 28 is a cross-sectional view of a dielectric resonator antenna according to a modification of the twelfth embodiment.

FIG. 28 is a cross-sectional view of a dielectric resonator antenna according to a modification of the twelfth embodiment.

As shown in FIG. 28, it is applicable that a dielectric film 125 having a supporting portion be used in place of the dielectric film 122. In this case, a lower curved surface of the hemispherical dielectric resonator 73 is supported by the supporting portion of the dielectric film 125.

Also, it is applicable that a dielectric resonator array antenna be constructed by unifying a plurality of dielectric resonator antennas 121.

Also, it is applicable that the coaxial feeder 74 be used in place of the feeder circuit substrate 112 and the microstrip feeding line 114.

Thirteenth Embodiment

Figure 29:
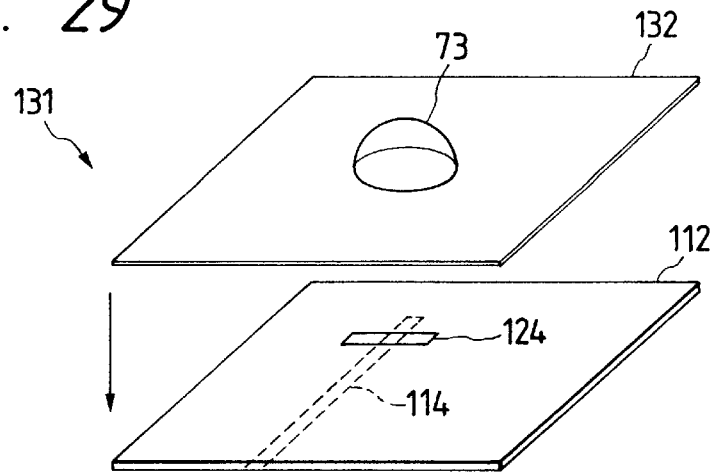
FIG. 29 is an exploded oblique view of a dielectric resonator antenna according to a thirteenth embodiment of the present invention.
Figure 30:
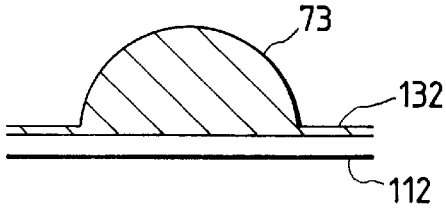
FIG. 30 is a cross-sectional view of the dielectric resonator antenna shown in FIG. 29.

FIG. 29 is an exploded oblique view of a dielectric resonator antenna according to a thirteenth embodiment of the present invention, and FIG. 30 is a cross-sectional view of the dielectric resonator antenna shown in FIG. 29.

As shown in FIGS. 29 and 30, a dielectric resonator antenna 131 comprises the feeder circuit substrate 112 having the grounded conductive film on its ground surface side, an antenna flexible sheet 132 made of the first dielectric material, the hemispherical dielectric resonator 73 integrally formed with the antenna flexible sheet 132, the microstrip feeding line 114, and the signal feeding slot 124.

In the above configuration, because the antenna flexible sheet 132 is considerably thin as compared with a thickness of the hemispherical dielectric resonator 73, an influence of the antenna flexible sheet 132 on resonance characteristics of the hemispherical dielectric resonator 73 is very low. Therefore, the dielectric resonator antenna 131 functions as a radiation device.

Accordingly, because the hemispherical dielectric resonator 73 is integrally formed with the antenna flexible sheet 132, the hemispherical dielectric resonator 73 can be easily fixed to the feeder circuit substrate 112, and the dielectric resonator antenna 131 can be obtained at a low cost.

Fourteenth Embodiment

Figure 31:
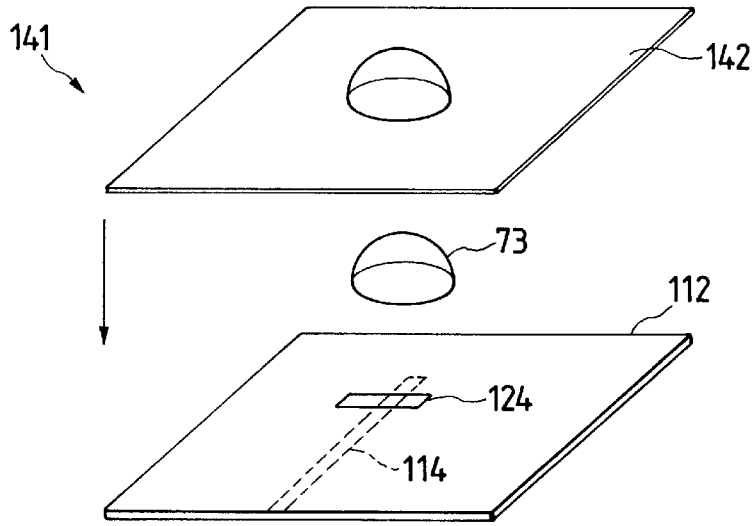
FIG. 31 is an exploded oblique view of a dielectric resonator antenna according to a fourteenth embodiment of the present invention.
Figure 32:
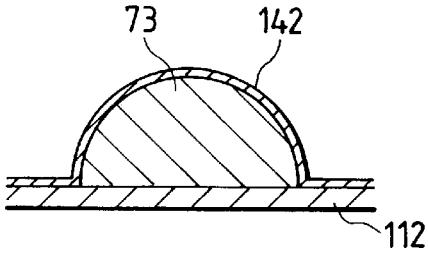
FIG. 32 is a cross-sectional view of the dielectric resonator antenna shown in FIG. 31.

FIG. 31 is an exploded oblique view of a dielectric resonator antenna according to a fourteenth embodiment of the present invention, and FIG. 32 is a cross-sectional view of the dielectric resonator antenna shown in FIG. 31.

As shown in FIGS. 31 and 32, a dielectric resonator antenna 141 comprises the feeder circuit substrate 112, the hemispherical dielectric resonator 73 arranged on the feeder circuit substrate 112, a dielectric film 142 arranged on the feeder circuit substrate 112 while covering the hemispherical dielectric resonator 73 to tightly fix the hemispherical dielectric resonator 73 to the feeder circuit substrate 112, the microstrip feeding line 114, and the signal feeding slot 124.

A relative dielectric constant of the dielectric film 142 is considerably lower than that of the hemispherical dielectric resonator 73, and the dielectric film 142 is thin as compared with a thickness of the hemispherical dielectric resonator 73. Therefore, an influence of the dielectric film 142 on resonance characteristics and radiation characteristics of the hemispherical dielectric resonator 73 is very low, and the dielectric resonator antenna 141 functions as a radiation device.

Accordingly, the dielectric resonator antenna 141 in which the hemispherical dielectric resonator 73 is tightly fixed to the feeder circuit substrate 112 by the dielectric film 142 can be obtained.

It is applicable that the coaxial feeder 74 be used in place of the feeder circuit substrate 112 and the microstrip feeding line 114.

Fifteenth Embodiment

Figure 33:
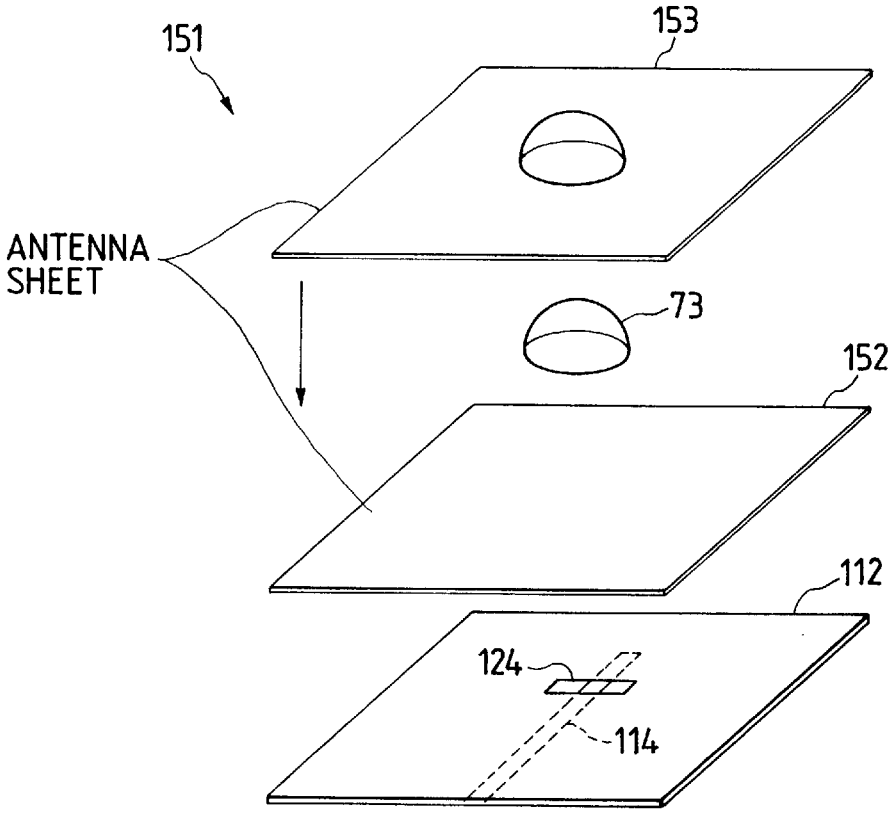
FIG. 33 is an exploded oblique view of a dielectric resonator antenna according to a fifteenth embodiment of the present invention.
Figure 34:
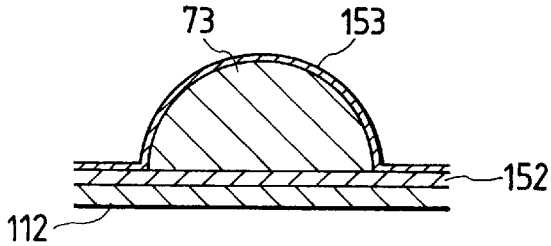
FIG. 34 is a cross-sectional view of the dielectric resonator antenna shown in FIG. 33.

FIG. 33 is an exploded oblique view of a dielectric resonator antenna according to a fifteenth embodiment of the present invention, and FIG. 34 is a cross-sectional view of the dielectric resonator antenna shown in FIG. 33.

As shown in FIGS. 33 and 34, a dielectric resonator antenna 151 comprises the feeder circuit substrate 112, a first dielectric film 152 arranged on the feeder circuit substrate 112, the hemispherical dielectric resonator 73 arranged on the first dielectric film 152, a second dielectric film 153 arranged on the first dielectric film 152 while covering the hemispherical dielectric resonator 73 to tightly fix the hemispherical dielectric resonator 73 to the first dielectric film 152, the microstrip feeding line 114, and the signal feeding slot 124. An antenna flexible sheet is composed of the first and second dielectric films 152 and 153.

Relative dielectric constants of the first and second dielectric films 152 and 153 are considerably lower than that of the hemispherical dielectric resonator 73, and the first and second dielectric films 152 and 153 are thin as compared with a thickness of the hemispherical dielectric resonator 73. Therefore, an influence of the first and second dielectric films 152 and 153 on resonance characteristics and radiation characteristics of the hemispherical dielectric resonator 73 is very low, and the dielectric resonator antenna 151 functions as a radiation device.

Accordingly, the hemispherical dielectric resonator 73 formed in a flexible sheet shape can be tightly fixed to the feeder circuit substrate 112 by arranging the hemispherical dielectric resonator 73 between the first and second dielectric films 152 and 153 of the antenna flexible sheet, and the dielectric resonator antenna 151 can be obtained at a low cost.

Also, an array antenna can be easily obtained by unifying a plurality of dielectric resonator antennas 151.

It is applicable that the coaxial feeder 74 be used in place of the feeder circuit substrate 112 and the microstrip feeding line 114.

Figure 35:
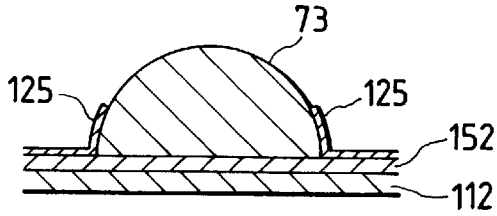
FIG. 35 is a cross-sectional view of a dielectric resonator antenna according to a modification of the fifteenth embodiment.

FIG. 35 is a cross-sectional view of a dielectric resonator antenna according to a modification of the fifteenth embodiment.

As shown in FIG. 35, it is applicable that the dielectric film 125 having a supporting portion be used in place of the second dielectric film 153.

Sixteenth Embodiment

Figure 36:
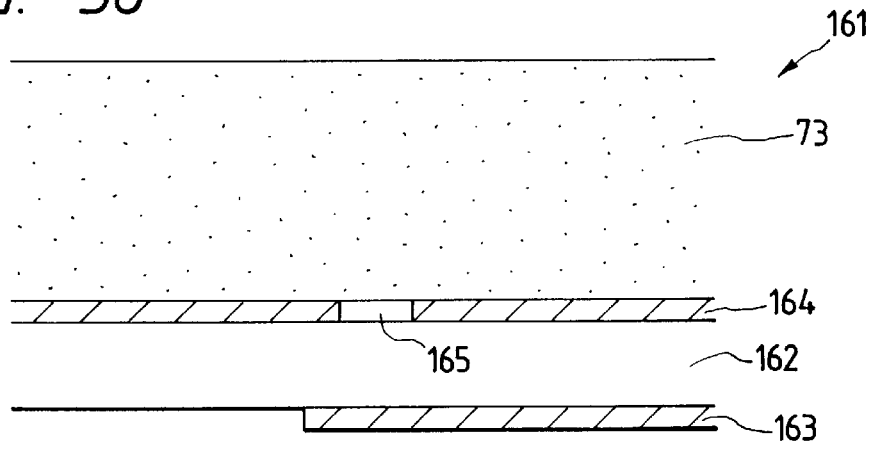
FIG. 36 is an enlarged cross-sectional view of a dielectric resonator antenna according to a sixteenth embodiment of the present invention.

FIG. 36 is an enlarged cross-sectional view of a dielectric resonator antenna according to a sixteenth embodiment of the present invention.

As shown in FIG. 36, a dielectric resonator antenna 161 comprises a dielectric film 162, a patterned circuit 163 drawn on a rear surface of the dielectric film 162, a grounded conductive substrate 164 arranged on a front surface of the dielectric film 162 to form a signal feeding slot 165 placed just above the patterned circuit 163, and the hemispherical dielectric resonator 73 arranged on the grounded conductive substrate 164 and the signal feeding slot 165.

In the above configuration, an input signal transmitting through the patterned circuit 163 is fed to the hemispherical dielectric resonator 73 through the signal feeding slot 165, the hemispherical dielectric resonator 73 is resonated, and an electromagnetic wave is radiated from the hemispherical dielectric resonator 73.

In this case, because the patterned circuit 163 is drawn on the rear surface of the dielectric film 162, the grounded conductive substrate 164 can be arranged between the hemispherical dielectric resonator 73 and the dielectric film 162. That is, metal conductive layers (the patterned circuit 163 and the grounded conductive substrate 164) and dielectric layers (the dielectric film 162 and the hemispherical dielectric resonator 73) are alternately arranged in the dielectric resonator antenna 161 to heighten the adhesion between the layers. Therefore, the hemispherical dielectric resonator 73 is tightly fixed to the grounded conductive substrate 164, and the grounded conductive substrate 164 is tightly fixed to the dielectric film 162. That is, the hemispherical dielectric resonator 73 is tightly fixed to the dielectric film 162.

Accordingly, the dielectric resonator antenna 161 in which the input signal transmitting through the patterned circuit 163 is reliably fed to the hemispherical dielectric resonator 73 can be obtained. Also, because the dielectric film 162 can be thin, the dielectric resonator antenna 161 can be downsized.

It is preferred that a passive or active circuit chip be connected to the patterned circuit 163 through a micro-bump.

Seventeenth Embodiment

Figure 37:
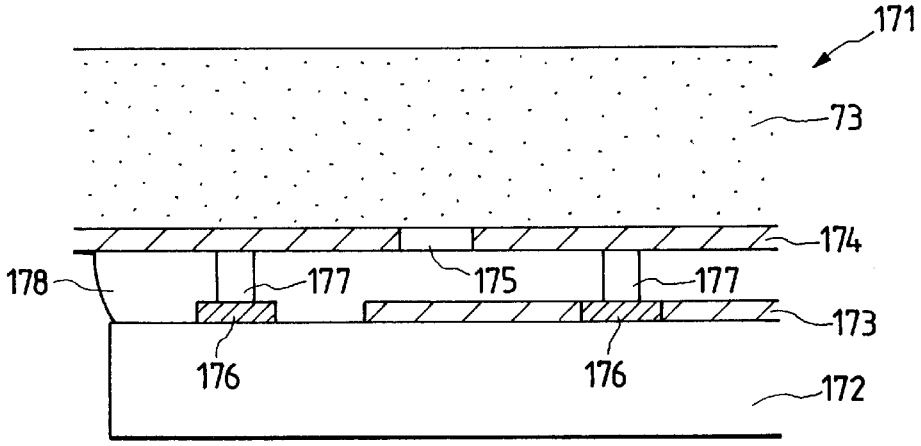
FIG. 37 is an enlarged cross-sectional view of a dielectric resonator antenna according to a seventeenth embodiment of the present invention.

FIG. 37 is an enlarged cross-sectional view of a dielectric resonator antenna according to a seventeenth embodiment of the present invention.

As shown in FIG. 37, a dielectric resonator antenna 171 comprises a circuit chip 172, a patterned circuit 173 drawn on the circuit chip 172, a grounded conductive substrate 174 having a signal feeding slot 175, the hemispherical dielectric resonator 73 arranged on the grounded conductive substrate 174, a plurality of bump pads 176 arranged on the circuit chip 172, a plurality of micro-bumps 177 arranged between the grounded conductive substrate 174 and the bump pads 176 for supporting the hemispherical dielectric resonator 73 and the grounded conductive substrate 174 on the patterned circuit 173 and the circuit chip 172, and a photo-curing type of resin layer 178 packed between the grounded conductive substrate 174 and the circuit chip 172.

A set of the hemispherical dielectric resonator 73 and the grounded conductive substrate 174 and a set of the patterned circuit 173 and the circuit chip 172 are separately produced. Therefore, the circuit chip 172 can be arbitrarily changed, and the hemispherical dielectric resonator 73 can be used for various purposes.

Eighteenth Embodiment

Figure 38:
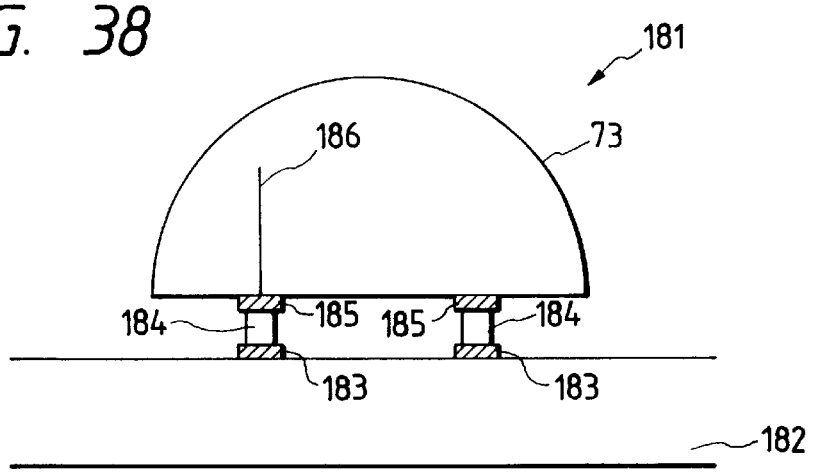
FIG. 38 is an enlarged cross-sectional view of a dielectric resonator antenna according to an eighteenth embodiment of the present invention.

FIG. 38 is an enlarged cross-sectional view of a dielectric resonator antenna according to an eighteenth embodiment of the present invention.

As shown in FIG. 38, a dielectric resonator antenna 181 comprises a circuit substrate 182 having the microstrip feeding line 114, a plurality of lower bump pads 183 arranged on the circuit substrate 182, a plurality of micro-bumps 184 arranged on the lower bump pads 183, a plurality of upper bump pads 185 arranged on the micro-bumps 184, the hemispherical dielectric resonator 73 supported on the upper bump pads 185, and a signal feeding line 186 buried in the hemispherical dielectric resonator 73.

A set of the hemispherical dielectric resonator 73 and the signal feeding line 186 is fixedly put on the circuit substrate 182 through the micro-bumps 184. Therefore, the hemispherical dielectric resonator 73 can be tightly fixed to the circuit substrate 182.

Also, a set of the hemispherical dielectric resonator 73 and the signal feeding line 186 can be easily changed to another set. Therefore, a frequency of an electromagnetic wave radiated from the dielectric resonator antenna 181 can be easily adjusted.

Nineteenth Embodiment

Figure 39:
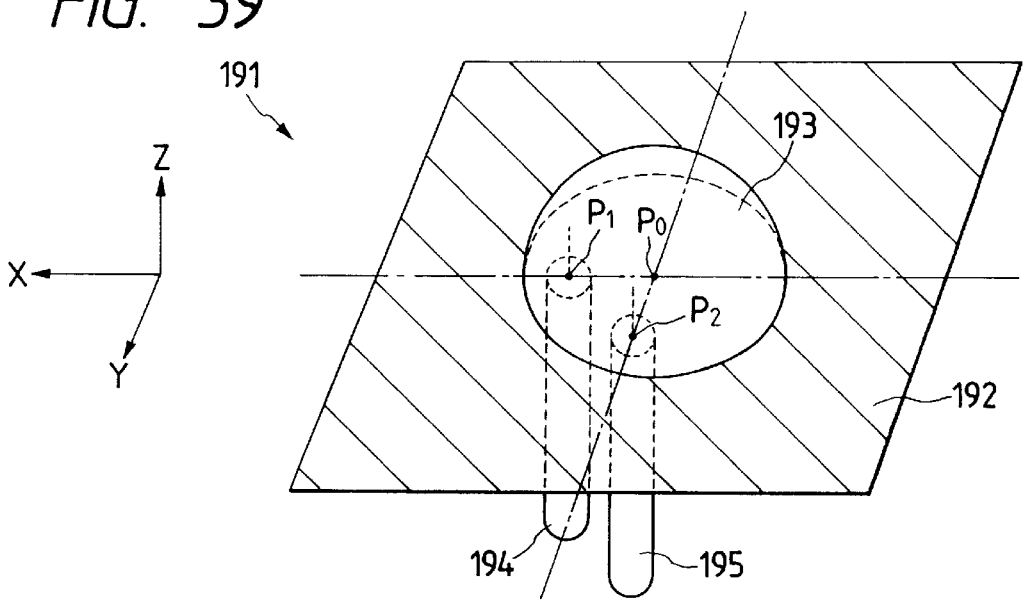
FIG. 39 is an oblique perspective view of a dielectric resonator antenna according to a nineteenth embodiment of the present invention.

FIG. 39 is an oblique perspective view of a dielectric resonator antenna according to a nineteenth embodiment of the present invention.

As shown in FIG. 39, a dielectric resonator antenna 191 comprises a metal substrate 192, a hemispherical dielectric resonator 193 arranged on the metal substrate 192 to make a flat surface of the hemispherical dielectric resonator 193 contact with an upper surface of the metal substrate 192, a first coaxial signal feeding line 194 connected with the metal substrate 192 and the hemispherical dielectric resonator 193 at a first feeding point P1 which is spaced from a central point P0 of the hemispherical dielectric resonator 193 by a distance x1 in an X direction, and a second coaxial signal feeding line 195 connected with the metal substrate 192 and the hemispherical dielectric resonator 193 at a second feeding point P2 which is spaced from the central point P0 by a distance y1 in a Y direction perpendicular to the X direction.

Figure 40:
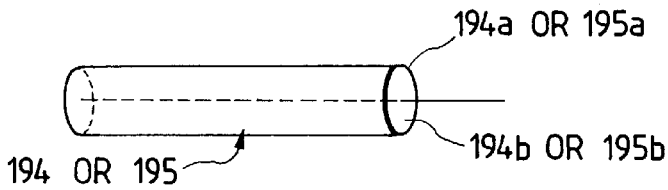
FIG. 40 is an oblique perspective view of a coaxial signal feeding line shown in FIG. 39.

As shown in FIG. 40, the first (or second) coaxial signal feeding line 194 (or 195) comprises an outer conductive body 194*a* (or 195*a*) connected with the conductive body 192 and an inner conductive line 194*b* (or 195*b*) inserted in the hemispherical dielectric resonator 193 from the flat surface of the hemispherical dielectric resonator 193. The first and second coaxial signal feeding lines 194 and 195 extend in a Z direction perpendicular to the conductive substrate 192 and are connected with an external apparatus (not shown). The length of the first coaxial signal feeding line 194 is the same as that of the second coaxial signal feeding line 195, so that first and second signals transmitting through the first and second coaxial signal feeding lines 194 and 195 and fed in the hemispherical dielectric resonator 193 have the same phase. The first and second positions P1 and P2 are determined according to the impedance of the hemispherical dielectric resonator 193 which is determined according to a dielectric constant distribution in the X and Y directions.

The hemispherical dielectric resonator 193 is unhomogeneously filled with various dielectric materials having different relative dielectric constants. Therefore, a changing degree of a relative dielectric constant per a unit length in the hemispherical dielectric resonator 193 is maximized in the X direction, and a changing degree of a relative dielectric constant per a unit length in the hemispherical dielectric resonator 193 is minimized in the Y direction.

Figure 41A:
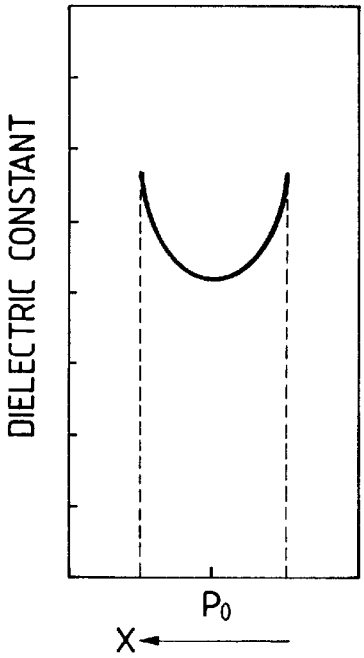
FIG. 41A shows a maximum change of a relative dielectric constant of a hemispherical dielectric resonator shown in FIG. 39 in an X direction.
Figure 41B:
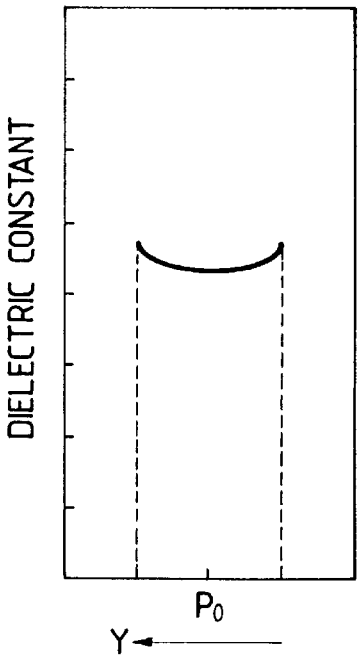
FIG. 41B shows a minimum change of a relative dielectric constant of a hemispherical dielectric resonator shown in FIG. 39 in a Y direction.

FIG. 41A shows a maximum change of the relative dielectric constant of the hemispherical dielectric resonator 193 in the X direction, and FIG. 41B shows a minimum change of the relative dielectric constant of the hemispherical dielectric resonator 193 in the Y direction.

As shown in FIGS. 41A and 41B, as a position shifts from the central position P0 to a peripheral portion of the hemispherical dielectric resonator 193, the relative dielectric constant greatly increases in the X direction, and the relative dielectric constant slightly increases in the Y direction. Also, the relative dielectric constant in another direction on the X-Y plane successively changes at an intermediate degree between the maximum and minimum degrees.

In the above configuration, when a fist signal transmitting through the first coaxial signal feeding line 194 and a second signal transmitting through the second coaxial signal feeding line 195 are fed in the hemispherical dielectric resonator 193 at the same phase, a first electric field is induced in the hemispherical dielectric resonator 193 by the first signal in the X direction, and a second electric field is induced in the hemispherical dielectric resonator 193 by the second signal in the Y direction. In this case, because the changing degree of the relative dielectric constant per a unit length in the X direction differs from that in the Y direction, an equivalent physical length for the first electric field in the X direction differs from that for the second electric field in the Y direction, and a first resonance frequency F1 for the first electric field in the X direction differs from a second resonance frequency F2 for the second electric field in the Y direction. Therefore, in cases where frequencies of the first and second signals are set to the same intermediate frequency F0 between the first and second resonance frequencies F1 and F2, a phase difference between the first and second electric fields is set to an angle of 90 degrees, and a combined electric field obtained by combining the first and second electric fields is radiated from the hemispherical dielectric resonator 193. Therefore, because the phase difference between the first and second electric fields is set to an angle of 90 degrees, a circularly polarized electromagnetic wave is radiated from the hemispherical dielectric resonator 193.

Figure 42:
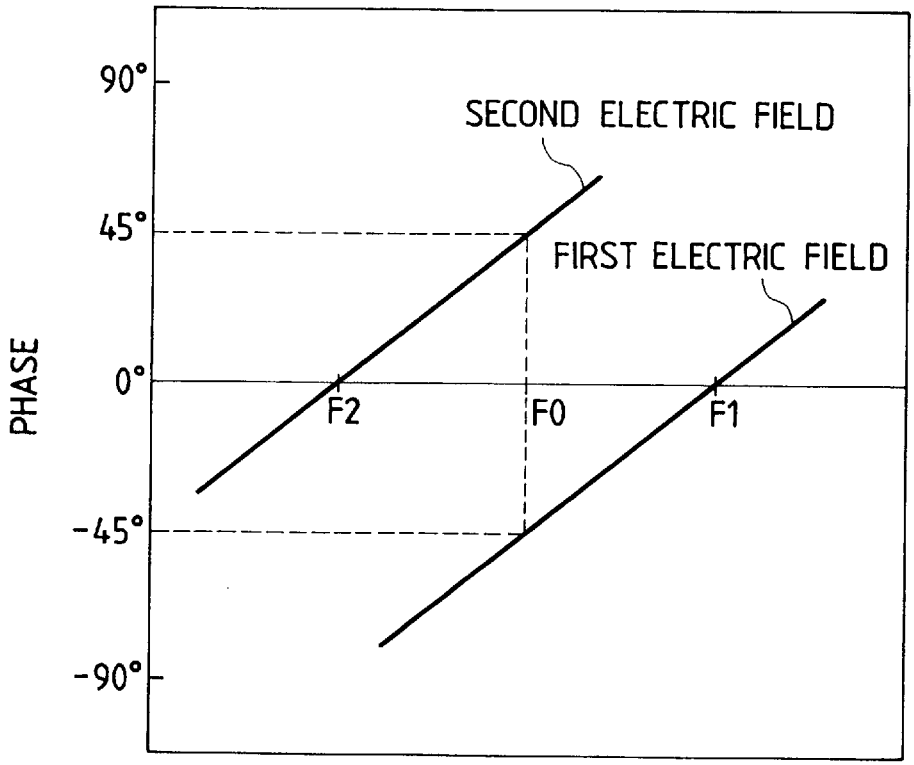
FIG. 42 shows a relationship between phase and frequency of a first electric field induced in the X direction and another relationship between phase and frequency of a second electric field induced in the Y direction.

FIG. 42 shows a relationship between phase and frequency of the first electric field induced in the X direction and another relationship between phase and frequency of the second electric field induced in the Y direction.

As shown in FIG. 42, because the changing degree of the relative dielectric constant per a unit length in the hemispherical dielectric resonator 193 is maximized in the X direction, an equivalent physical length of the hemispherical dielectric resonator 193 is minimized in the X direction, and a resonance frequency is maximized to the first resonance frequency F1. In contrast, because the changing degree of the relative dielectric constant per a unit length in the hemispherical dielectric resonator 193 is minimized in the Y direction, an equivalent physical length of the hemispherical dielectric resonator 193 is maximized in the Y direction, and a resonance frequency is minimized to the second resonance frequency F2. Therefore, in cases where frequencies of the first and second signals are set to the same intermediate frequency F0 between the first and second resonance frequencies F1 and F2, a first phase of the first electric field induced in the X direction is an angle of −45 degrees at a prescribed time, and a second phase of the second electric field induced in the Y direction is an angle of +45 degrees at the same prescribed time. Therefore, the first and second electric fields of which the different phase is 90 degrees are combined, and the circularly polarized electromagnetic wave generated by the combined electric field is radiated from the hemispherical dielectric resonator 193.

Accordingly, even though the hemispherical dielectric resonator 193 having a symmetrical shape in the X and Y directions is used in the dielectric resonator antenna 191, because the changing degree of the relative dielectric constant per a unit length in the X direction in the hemispherical dielectric resonator 193 differs from that in the Y direction perpendicular to the X direction, the first and second electric fields of which the difference phase is 90 degrees can be induced perpendicularly to each other in the hemispherical dielectric resonator 193, and the circularly polarized electromagnetic wave can be radiated from the dielectric resonator antenna 191.

Figure 43:
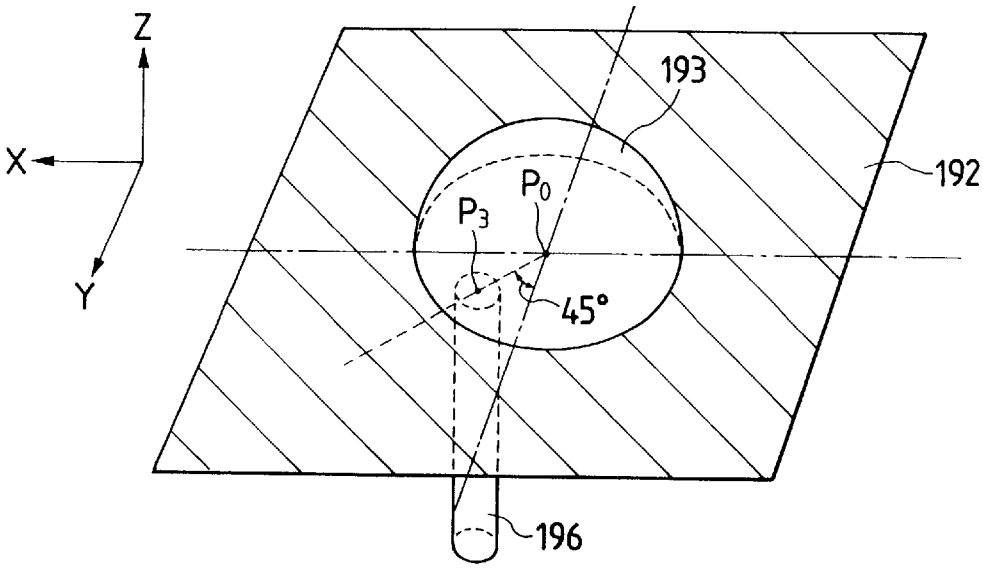
FIG. 43 is an oblique perspective view of a dielectric resonator antenna according to a modification of the nineteenth embodiment.

FIG. 43 is an oblique perspective view of a dielectric resonator antenna according to a modification of the nineteenth embodiment.

In the dielectric resonator antenna 191, the first and second coaxial feeding lines 194 and 195 are used. However, as shown in FIG. 43, it is applicable that a coaxial feeding line 196 connected with the metal substrate 192 and the hemispherical dielectric resonator 193 at a third feeding point P3 be used in place of the first and second coaxial feeding lines 194 and 195 on condition that a direction of a line connecting the third feeding point P3 and the central point P0 differs from the X direction by an angle of 45 degrees.

Twentieth Embodiment

Figure 44:
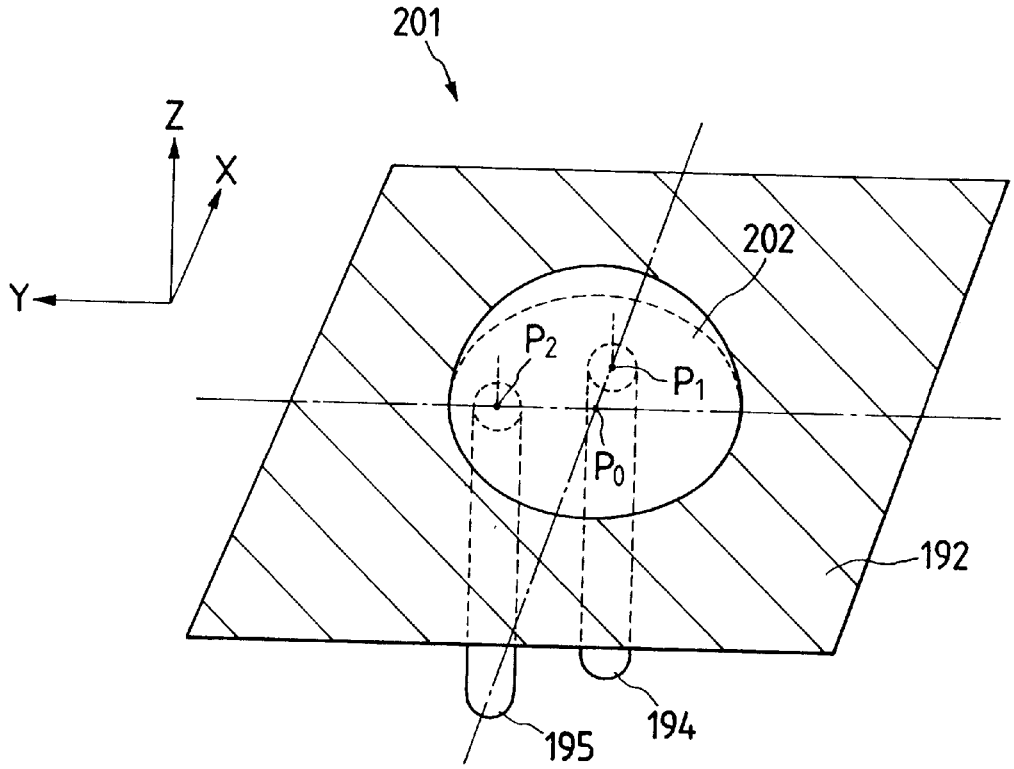
FIG. 44 is an oblique perspective view of a dielectric resonator antenna according to a twentieth embodiment of the present invention.

FIG. 44 is an oblique perspective view of a dielectric resonator antenna according to a twentieth embodiment of the present invention.

As shown in FIG. 44, a dielectric resonator antenna 201 comprises the metal substrate 192, a semi-spheroidal dielectric resonator 202 arranged on the metal substrate 192 to make a flat surface of the semi-spheroidal dielectric resonator 202 contact with an upper surface of the metal substrate 192, the first coaxial signal feeding line 194 connected with the metal substrate 192 and the semi-spheroidal dielectric resonator 202 at a first feeding point P1 which is spaced from a central point P0 of the semi-spheroidal dielectric resonator 202 by a distance x1 in an X direction, and the second coaxial signal feeding line 195 connected with the metal substrate 192 and the semi-spheroidal dielectric resonator 202 at a second feeding point P2 which is spaced from the central point P0 by a distance y1 in a Y direction perpendicular to the X direction.

The semi-spheroidal dielectric resonator 202 is filled with a dielectric material. Therefore, a relative dielectric constant of the semi-spheroidal dielectric resonator 202 does not change in any position of the semi-spheroidal dielectric resonator 202. The first point P1 shifts from the central position P0 in a direction of a minor axis of the semi-spheroidal dielectric resonator 202, and the second point P2 shifts from the central position P0 in a direction of a major axis of the semi-spheroidal dielectric resonator 202.

In the above configuration, when a fist signal transmitting through the first coaxial signal feeding line 194 and a second signal transmitting through the second coaxial signal feeding line 195 are fed in the semi-spheroidal dielectric resonator 202 at the same phase, a first electric field is induced in the semi-spheroidal dielectric resonator 202 by the first signal in the X direction, and a second electric field is induced in the semi-spheroidal dielectric resonator 202 by the second signal in the Y direction. In this case, because a length of the semi-spheroidal dielectric resonator 202 in the X direction differs from that in the Y direction, a first resonance frequency F1 for the first electric field in the X direction differs from a second resonance frequency F2 for the second electric field in the Y direction. Therefore, in cases where frequencies of the first and second signals are set to the same intermediate frequency F0 between the first and second resonance frequencies F1 and F2, as shown in FIG. 42, a phase difference between the first and second electric fields is set to an angle of 90 degrees, and a combined electric field obtained by combining the first and second electric fields is radiated from the semi-spheroidal dielectric resonator 202. Therefore, because the phase difference between the first and second electric fields is set to an angle of 90 degrees, a circularly polarized electromagnetic wave is radiated from the semi-spheroidal dielectric resonator 202.

Accordingly, because the semi-spheroidal dielectric resonator 202 having an asymmetrical shape in the X and Y directions is used in the dielectric resonator antenna 201, the first and second electric fields of which the difference phase is 90 degrees can be induced perpendicularly to each other in the semi-spheroidal dielectric resonator 202, and the circularly polarized electromagnetic wave can be radiated from the dielectric resonator antenna 201.

Figure 45:
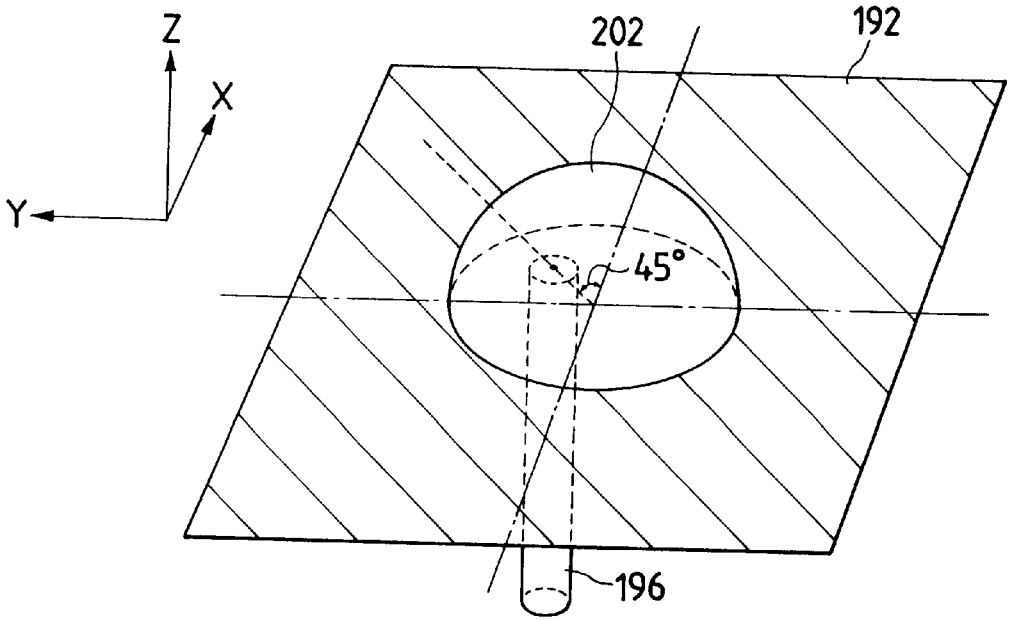
FIG. 45 is an oblique perspective view of a dielectric resonator antenna according to a modification of the twentieth embodiment.

FIG. 45 is an oblique perspective view of a dielectric resonator antenna according to a modification of the twentieth embodiment.

In the dielectric resonator antenna 201, the first and second coaxial feeding lines 194 and 195 are used. However, as shown in FIG. 45, it is applicable that the coaxial feeding line 196 connected with the metal substrate 192 and the semi-spheroidal dielectric resonator 202 at a third feeding point P3 be used in place of the first and second coaxial feeding lines 194 and 195 on condition that a direction of a line connecting the third feeding point P3 and the central point P0 differs from the X direction by an angle of 45 degrees.

Twenty-first Embodiment

Figure 46:
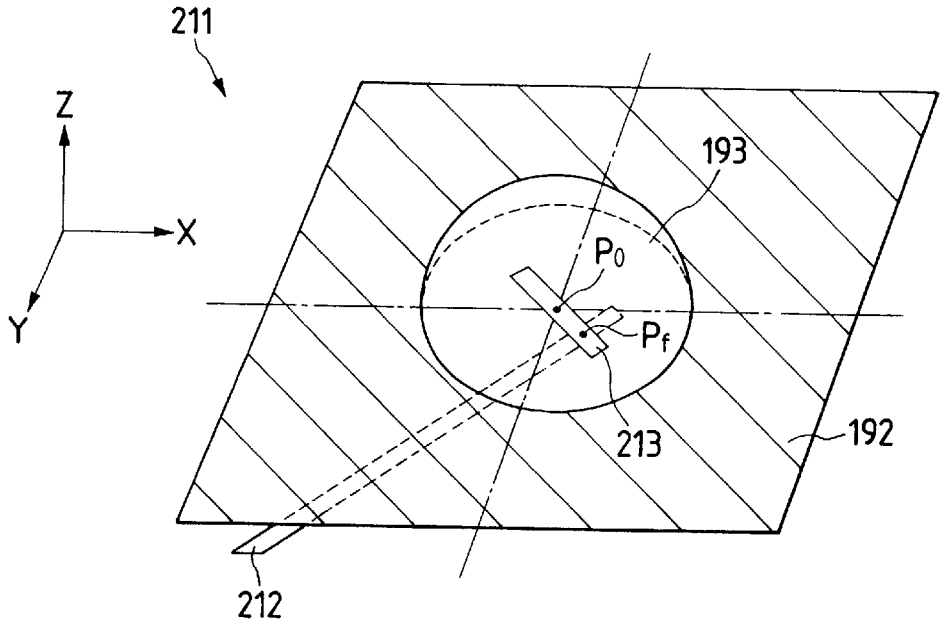
FIG. 46 is an oblique perspective view of a dielectric resonator antenna according to a twenty-first embodiment of the present invention.

FIG. 46 is an oblique perspective view of a dielectric resonator antenna according to a twenty-first embodiment of the present invention.

As shown in FIG. 46, a dielectric resonator antenna 211 comprises the metal substrate 192, the hemispherical dielectric resonator 193 arranged on the metal substrate 192 to make a flat surface of the hemispherical dielectric resonator 193 contact with an upper surface of the metal substrate 192, a signal feeding line 212 arranged on a rear surface side of the conductive plate 192 in parallel to the conductive plate 192 and spaced from the conductive plate 192, and a signal feeding slot 213 which is obtained by opening a portion of the conductive plate 192 and is arranged just under the hemispherical dielectric resonator 193 while perpendicularly crossing over the signal feeding line 212 at a feeding point Pf.

A longitudinal direction of the signal feeding slot 213 is perpendicular to that of the signal feeding line 212, and a direction of a line connecting the feeding point Pf and the central point P0 differs from the X direction by an angle of 45 degrees.

The signal feeding line 212 is a conductive body.

In the above configuration, when an input signal is transmitted through the signal feeding line 212, the input signal is fed in the hemispherical dielectric resonator 193 though the signal feeding slot 213, and an electric field directed in a particular direction perpendicular to the longitudinal direction of the signal feeding slot 213 on the X-Y plane is induced by the input signal. Therefore, a first component of the electric field is directed in the X direction at a first resonance frequency F1, a second component of the electric field is directed in the Y direction at a second resonance frequency F2, and the first resonance frequency F1 differs from the second resonance frequency F2 in the same reason as in the nineteenth embodiment. Therefore, in cases where a frequency of the input signal is set to an intermediate frequency F0 between the first and second resonance frequencies F1 and F2, a phase difference between the first and second components of the electric field is set to an angle of 90 degrees, and a circularly polarized electromagnetic wave is radiated from the hemispherical dielectric resonator 193.

Accordingly, because the input signal is transmitted through the signal feeding line 212 arranged in parallel to the conductive plate 192, a signal feeding means of the dielectric resonator antenna 211 can be formed in a plane configuration.

In the twenty-first embodiment, the hemispherical dielectric resonator 193 is used. However, it is applicable that the semi-spheroidal dielectric resonator 202 be used in place of the hemispherical dielectric resonator 193.

Also, it is applicable that a dielectric body be additionally arranged between the conductive plane 192 and the signal feeding line 212. In this case, a set of the dielectric body and the signal feeding line 212 functions as a microstrip line for transmitting a signal.

Twenty-second Embodiment

Figure 47:
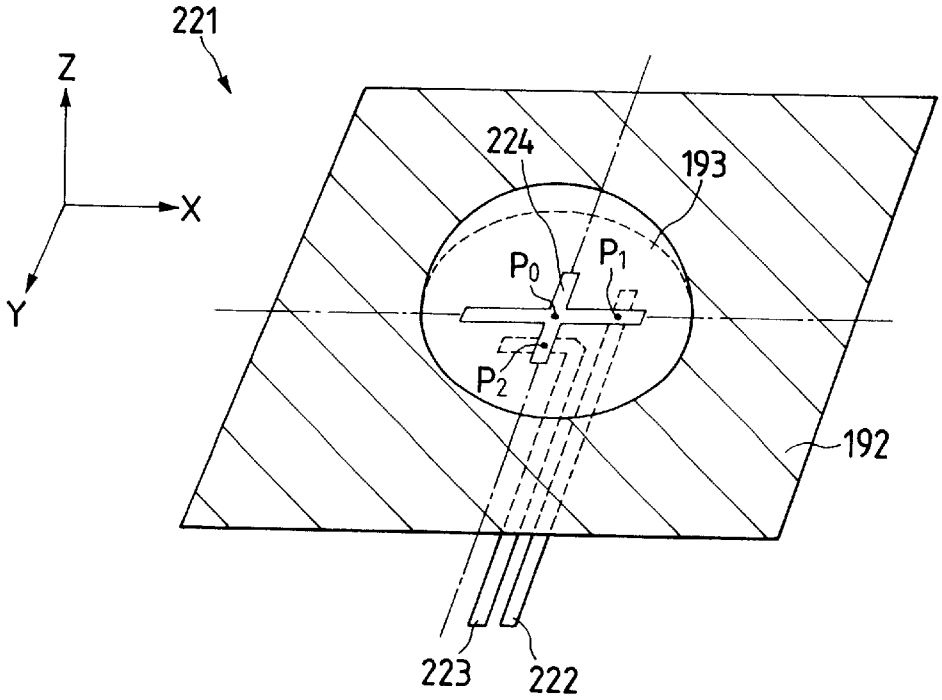
FIG. 47 is an oblique perspective view of a dielectric resonator antenna according to a twenty-second embodiment of the present invention.
Figure 48:
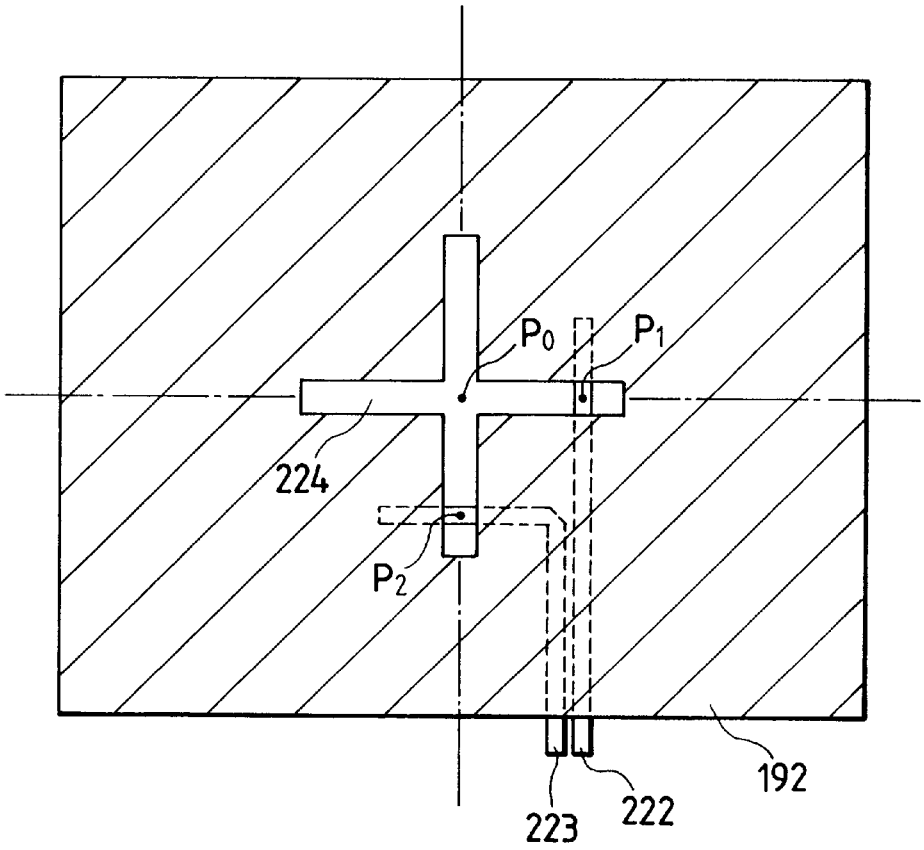
FIG. 48 is a plan view of the dielectric resonator antenna shown in FIG. 47.

FIG. 47 is an oblique perspective view of a dielectric resonator antenna according to a twenty-second embodiment of the present invention, and FIG. 48 is a plan view of the dielectric resonator antenna shown in FIG. 47.

As shown in FIGS. 47 and 48, a dielectric resonator antenna 221 comprises the metal substrate 192, the hemispherical dielectric resonator 193, a first signal feeding line 222 arranged on a rear surface side of the conductive plate 192 in parallel to the conductive plate 192 and spaced from the conductive plate 192, a second signal feeding line 223 arranged on the rear surface side of the conductive plate 192 in parallel to the conductive plate 192 and spaced from the conductive plate 192, and a cross-shaped signal feeding slot 224 which is obtained by opening a portion of the conductive plate 192 and is arranged just under the hemispherical dielectric resonator 193 while perpendicularly crossing over the first and second signal feeding lines 222 and 223 at first and second feeding points P1 and P2.

A central position of the cross-shaped signal feeding slot 224 agrees with the central position P0 of the hemispherical dielectric resonator 193, a first longitudinal direction of the cross-shaped signal feeding slot 224 agrees with the X direction, and a second longitudinal direction of the cross-shaped signal feeding slot 224 agrees with the Y direction. Also, the first feeding point P1 is spaced from the central point P0 by a distance x1 in the X direction, and the second feeding point P2 is spaced from the central point P0 by a distance y1 in the Y direction perpendicular to the X direction.

The first and second signal feeding lines 222 and 223 are connected with an external apparatus (not shown). The length of the first signal feeding line 222 is the same as that of the second signal feeding line 223, so that first and second signals transmitting through the first and second signal feeding lines 222 and 223 and fed in the hemispherical dielectric resonator 193 have the same phase.

In the above configuration, when a first signal is transmitted through the first signal feeding line 222, the first signal is fed in the hemispherical dielectric resonator 193 though the cross-shaped signal feeding slot 224, and a first electric field directed in the Y direction perpendicular to the first longitudinal direction of the cross-shaped signal feeding slot 224 is induced by the first signal at a first resonance frequency F1. Also, a second signal is transmitted through the second signal feeding line 223, the second signal is fed in the hemispherical dielectric resonator 193 though the cross-shaped signal feeding slot 224 at the same phase as that of the first signal, and a second electric field directed in the X direction perpendicular to the second longitudinal direction of the cross-shaped signal feeding slot 224 is induced by the second signal at a second resonance frequency F2. In this case, the first resonance frequency F1 differs from the second resonance frequency F2 in the same reason as in the nineteenth embodiment. Therefore, in cases where frequencies of the first and second signals are set to the same intermediate frequency F0 between the first and second resonance frequencies F1 and F2, a phase difference between the first and second electric fields is set to an angle of 90 degrees, and a combined electric field obtained by combining the first and second electric fields is radiated from the hemispherical dielectric resonator 193. Therefore, because the phase difference between the first and second electric fields is set to an angle of 90 degrees, a circularly polarized electromagnetic wave is radiated from the hemispherical dielectric resonator 193.

Accordingly, because the first and second signals are transmitted through the signal feeding lines 222 and 223 arranged in parallel to the conductive plate 192, a signal feeding means of the dielectric resonator antenna 221 can be formed in a plane configuration.

In the twenty-second embodiment, the hemispherical dielectric resonator 193 is used. However, it is applicable that the semi-spheroidal dielectric resonator 202 be used in place of the hemispherical dielectric resonator 193.

Also, it is applicable that a dielectric body be additionally arranged between the conductive plane 192 and the signal feeding lines 222 and 223. In this case, a set of the dielectric body and the first signal feeding line 222 and a set of the dielectric body and the second signal feeding line 223 respectively function as a microstrip line for transmitting a signal.

Twenty-third Embodiment

Figure 49:
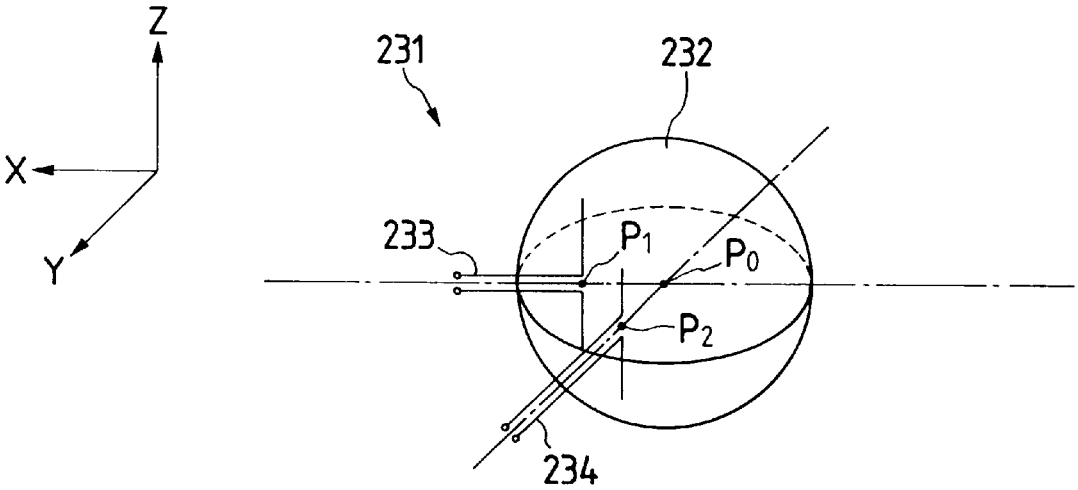
FIG. 49 is an oblique perspective view of a dielectric resonator antenna according to a twenty-third embodiment of the present invention.

FIG. 49 is an oblique perspective view of a dielectric resonator antenna according to a twenty-third embodiment of the present invention.

As shown in FIG. 49, a dielectric resonator antenna 231 comprises a spherical dielectric resonator 232, a first parallel signal feeding line 233 connected with the spherical dielectric resonator 232 at a first feeding point P1 which is spaced from a central point P0 of the spherical dielectric resonator 232 by a distance x1 in an X direction, and a second parallel signal feeding line 234 connected with the spherical dielectric resonator 232 at a second feeding point P2 which is spaced from the central point P0 by a distance y1 in a Y direction perpendicular to the X direction.

The spherical dielectric resonator 232 is unhomogeneously filled with various dielectric materials having different relative dielectric constants. Therefore, as shown in FIGS. 41A and 41B, a changing degree of a relative dielectric constant per a unit length in the spherical dielectric resonator 232 is maximized in the X direction, and a changing degree of a relative dielectric constant per a unit length in the spherical dielectric resonator 232 is minimized in the Y direction.

The first and second parallel signal feeding lines 233 and 234 are respectively connected with a dipole antenna (not shown), and the spherical dielectric resonator 232 is supported by the first and second parallel signal feeding lines 233 and 234. The length of the first parallel signal feeding line 233 is the same as that of the second parallel signal feeding line 234, so that first and second signals transmitting through the first and second parallel signal feeding lines 233 and 234 and fed in the spherical dielectric resonator 232 have the same phase. The first and second positions P1 and P2 are determined according to the impedance of the spherical dielectric resonator 232 which is determined according to a dielectric constant distribution in the X and Y directions.

In the above configuration, when first and second signals transmitting through the first and second parallel signal feeding lines 233 and 234 are fed in the spherical dielectric resonator 232, a circularly polarized electromagnetic wave is radiated from the spherical dielectric resonator 232 in the same manner as in the nineteenth embodiment.

Accordingly, even though the spherical dielectric resonator 232 having a symmetrical shape in the X and Y directions is used in the dielectric resonator antenna 231, because the changing degree of the relative dielectric constant per a unit length in the X direction in the spherical dielectric resonator 232 differs from that in the Y direction perpendicular to the X direction, the first and second electric fields of which the difference phase is 90 degrees can be induced perpendicularly to each other in the spherical dielectric resonator 232, and the circularly polarized electromagnetic wave can be radiated from the dielectric resonator antenna 231.

In the twenty-third embodiment, the spherical dielectric resonator 232 unhomogeneously filled with various dielectric materials having different relative dielectric constants is used. However, it is applicable that a spheroidal dielectric resonator having a relative dielectric constant be used in place of the spherical dielectric resonator 232.

Having illustrated and described the principles of the present invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A dielectric resonator antenna comprising:

a feeder circuit substrate having a conductive film on its upper surface;

a solid dielectric resonator for radiating an electromagnetic wave according to a signal;

a dielectric film arranged on the upper surface of the feeder circuit substrate to fix the solid dielectric resonator to the feeder circuit substrate;

a microstrip feeding line arranged on a lower surface of the feeder circuit substrate for transmitting the signal to the solid dielectric resonator; and a signal feeding slot arranged in the conductive film of the feeder circuit substrate and placed just under the solid dielectric resonator.

2. A dielectric resonator antenna according to claim 1 in which a relative dielectric constant of the dielectric film is lower than that of the solid dielectric resonator.

3. A dielectric resonator antenna according to claim 1 in which the solid dielectric resonator is a hemispherical dielectric resonator, and a flat surface of the hemispherical dielectric resonator contacts with the feeder circuit substrate.

4. A dielectric resonator antenna according to claim 1 in which the dielectric film has a fixing hole in which a portion of the solid dielectric resonator is tightly set to fix the solid dielectric resonator to the feeder circuit substrate.

* * * * *